United States Patent [19]

Aimbinder et al.

[11] 3,981,130

[45] Sept. 21, 1976

[54] SINGLE PROCESS TWISTING MACHINE FOR PRODUCING TWISTED YARN FROM TWO STRANDS

[76] Inventors: Mark Borisovich Aimbinder, ulitsa Predslavinskaya, 47, kv. 32; Mikhail Iosifovich Zhitomirsky, Vozdukhoflotsky prospekt, 103/2, kv. 26, both of, Kiev; Maria Vasilievna Denisova, 1 Krasnoarmeisky pereulok, 11, kv. 12, Mytischi Moskovskoi oblasti; Anatoly Mikhailovich Grabilin, ulitsa Entuziastov, 29, kv. 14, Kiev; Grigory Alexeevich Lapushkin, Yasny proezd, 18, kv. 72, Moscow; Moisei Zusievich Kupershmidt, ulitsa Rovenskaya, 7, kv. 55, Kiev; Jury Alexeevich Mazov, ulitsa 1 Sportivnaya, 3, kv. 7, Mytischi Moskovskoi oblasti; Viktor Petrovich Terentiev, Kolomievsky pereulok, 3/1, kv. 75, Kiev; Jury Vasilievich Sergeev, ulitsa Pervomaiskaya, 25, kv. 74, Mytischi Moskovskoi oblasti; Vladimir Sergeevich Muzylev, stantsia Zagoryanskaya, ulitsa Kalinina, 59, Severnaya zheleznaya doroga, all of U.S.S.R.

[22] Filed: Feb. 1, 1974

[21] Appl. No.: 438,773

[52] U.S. Cl. ..... 57/58.3; 57/58.36; 57/58.7; 57/90

[51] Int. Cl.[2] ..... D01H 7/86

[58] Field of Search ..... 57/58.3, 58.34, 58.36, 57/58.38, 58.7, 58.86, 90, 58.83, 58.52, 58.54

[56] References Cited

UNITED STATES PATENTS

| | | | |
|---|---|---|---|
| 2,729,051 | 1/1956 | Clarkson | 57/58.3 |
| 3,295,304 | 1/1967 | Vibber | 57/58.3 |
| 3,307,342 | 3/1967 | Vibber | 57/58.3 |
| 3,499,277 | 3/1970 | Vibber | 57/58.3 |
| 3,605,394 | 9/1971 | Vibber | 57/58.3 |

*Primary Examiner*—John Petrakes
*Attorney, Agent, or Firm*—Holman & Stern

[57] ABSTRACT

A single-process twisting machine for production of twisted yarn from two strands is particularly adapted for cord production.

The machine comprises longitudinally spaced work stations, each work station including a twisting spindle, a device for balancing the tensioning of the strands, a feeding device, a take-up mechanism, strand tensioners, and a device for synchronous starting and arresting of the drives of the twisting spindle of the feeding device, and of the take-up mechanism. This synchronous starting and arresting device enables selective arrestment of any single work station, either automatically or manually, without stopping the entire machine.

The arbor of the spindle and the stationary holder of the bobbin of the supply package have provided therein coaxial through passages for forwarding a strand from the supply package via these passages to the device for balancing the tensioning of the strands, with the latter being mounted on the bottom end of the arbor. This provides for stepping up the quality of the yarn produced, and for reducing the dimensions of the machine.

17 Claims, 24 Drawing Figures

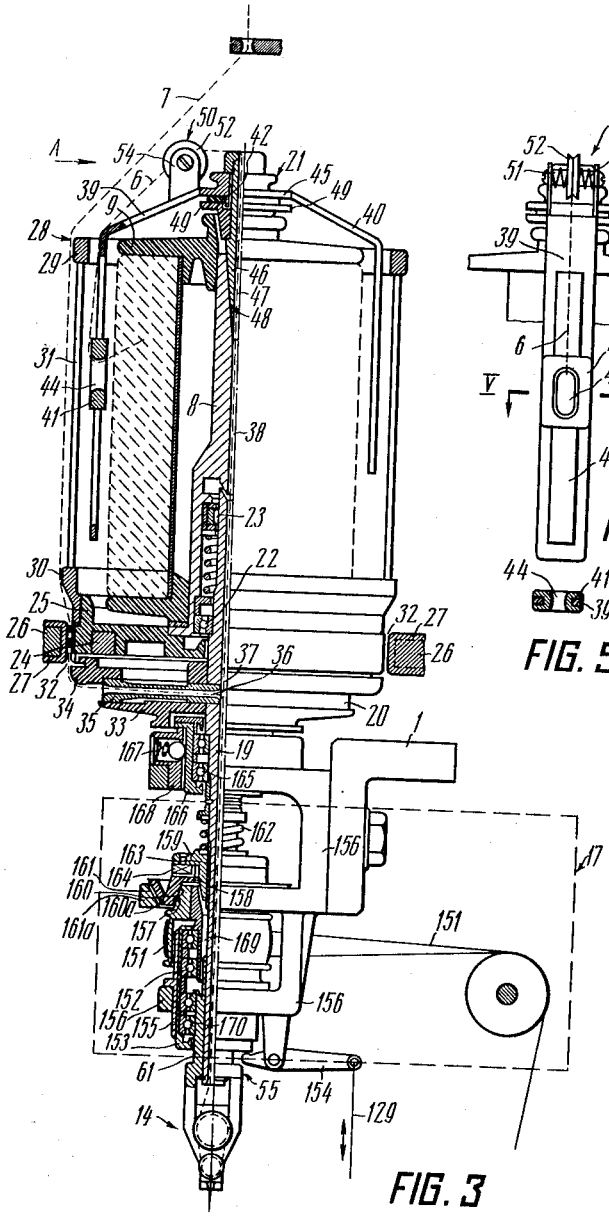
FIG. 3
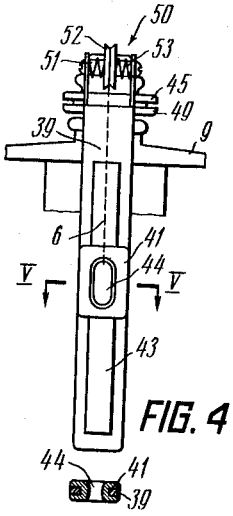
FIG. 4
FIG. 5

SINGLE PROCESS TWISTING MACHINE FOR PRODUCING TWISTED YARN FROM TWO STRANDS

BACKGROUND OF THE INVENTION

The present invention relates to textile machinery for producing twisted yarn and, more particularly, to single-process twisting machines for producing twisted yarn from two strands, e.g., cord yarn, threads for fishing nets and implements, etc.

There is known at present a single-process twisting machine for producing twisted yarn from two strands. This machine has work stations arranged along the longitudinal axis of the machine, with each work station including: a twisting spindle imparting the first twist and the second twist to the strands and incorporating an arbor with an axial passage and a radial passage, a twisting disc and a stationary holder of the bobbin of the supply package of the first strand associated with means for tensioning this strand, another holder of the bobbin of the supply package of the other strand arranged outside the twisting spindle and associated with means for tensioning this strand, a device for balancing the tensioning of the strands prior to imparting thereto the second twist forming the twisted yarn, a feed-in device, and a take-up mechanism and the respective drives of the twisting spindle, of the feed-in device, and of the take-up mechanism.

In this known machine the strand unwound from the bobbin of the stationary holder of the twisting spindle is fed directly into the tension balancing device, whereas the other strand unwound from the package of the holder arranged outside the spindle is fed into this device through the axial passage of the arbor and the twisting disc. This second strand, as it rotates, forms a balloon about the stationary holder.

An important requirement for normal operation of a single-process twisting machine is a timed starting and arresting of the mechanisms of any single work station, without the necessity of disabling the whole machine for the purpose.

This starting and arresting of any single work station, be it manual or automatic, is needed either to replace an exhausted supply package or to attend to breakage of either one of the two strands. The strands wound on the bobbins of the two supply packages being of different length, the bobbins are exhausted at different moments, and, consequently, when the supply package of either one of the strands is completely exhausted, it is necessary to arrest the work station, either manually or automatically, to prevent winding of a single-strand yarn on the take-up package.

However, the hitherto known single-process twisting machines are not provided with means for stopping any one of the work stations individually, without arresting the whole machine.

Another important requirement for profitable operation of the known single-process twisting machines is uniformity of the tensioning of the two strands prior to imparting the second twist thereto. Therefore, these machines incorporate a device mounted in the upper portion of the twisting spindle, on the stationary holder of the supply package, for balancing the tensioning of the strands.

The aforementioned arrangement of the balancing devices necessitates removal of these devices from the twisting spindles, as the packages are replaced, which increases downtime associated with package replacement and with threading the strands into this device. Furthermore, this arrangement is practically suitable solely for manual threading of the strands into the device for balancing their tension and precludes incorporation of automatic strand-threading means.

With the balancing devices arranged at the upper portion of the twisting spindle the conditions of tensioning of the two strands are not equal, which is reflected in a poorer quality of the yarn being produced, since the strand unwound from the package of the holder arranged outside the twisting spindle, as it forms a rotating balloon, imparts rotation to the device balancing the tensioning of the strands, and, consequently, is able to affect this balance of tensioning and the preset degree of tensioning.

With the device balancing the tensioning of the strands arranged at the upper portion of the twisting spindle and, therefore, inside the balloon, there evolves reduction of the maximum capacity of the package arranged on the stationary holder, since it is necessary to arrange below this device the means for tensioning the strand unwound from this package. Furthermore, the aforementioned feature impedes the provision of a device for balancing the tensioning of the strands, which would provide optimized conditions of paying the strand off packages of different shapes and ensure that the strand is uniformly tensioned throughout period of the gradual reduction of the volume of the package.

SUMMARY OF THE INVENTION

It is an object of the present invention to provide a highly productive single-process twisting machine for production of twisted yarn from two strands, wherein any of the work stations may be arrested at slackening or breakage of either strand without stopping the whole machine.

It is another object of the present invention to provide a single-process twisting machine wherein in every work station the device for balancing the tensioning of the strands, the feed-in device, and the take-up mechanism would be arranged to facilitate servicing and maintenance of the machine, step up labour productivity, and improve the quality of the yarn produced.

With these and other objects in view, the invention contemplates a single-process machine for producing twisted yarn from two strands, wherein work stations are arranged along the longitudinal axis of the machine, each work station including a twisting spindle imparting the first twist and the second twist to the strands. The spindle includes an arbor with an axial passage and a radial passage, a twisting disc and a stationary holder of the bobbin of the supply package of the first strand, associated with means for tensioning this strand and the holder of the bobbin of the supply package of the other strand arranged outside the spindle and associated with means for tensioning this second strand, a device for balancing the tensioning of the two strands prior to imparting thereto the second twist forming the twisted yarn, a feed-in device, a take-up mechanism and the respective drives of the feed-in device, the twisting spindle, and the take-up mechanism. In a machine in accordance with the present invention, in the stationary holder of the bobbin of the supply package of each working station there is made, coaxially with the axial passage of the arbor, a through passage for introduction of the strand from this bobbin into the axial passage of the arbor, which is also a through one. Each work station incorporates a device operatively connected with the respective drives of the spindle, of the feed-in device, and of the take-up mechanism, this device being adapted to effect synchronous starting and arresting of all the other devices of the work station and including a pickup responsive to the tension of the twisted yarn and adapted to send a signal upon slackening of this yarn to this device, to arrest the said drives, the pickup being arranged intermediate of the feed-in device and the device for balancing the tensioning of the strands, with the latter device being mounted on the lower portion of the arbor of the twisting spindle, below which there are arranged the feed-in device and the take-up mechanism.

With each work station of the machine being provided with the device for synchronous arresting and starting of the drives of the twisting spindle, of the feed-in device, and of the take-up mechanism, it has become possible to effect positive arresting and starting of any one of the work stations, without stopping the whole machine for the purpose, as well as to arrest automatically any work station upon slackening of the twisted yarn following either breakage of either one of the two strands or complete exhaustion of either supply package. This feature reduces the amount of waste and raises the productivity of the machine. Furthermore, this feature eliminates, or at least minimizes, non-uniformity of the twisting of the yarn at the starting and arresting of a work station, which non-uniformity may affect the strength of the yarn at certain portions thereof.

The provision of the coaxial through passages in the stationary holder and the arbor has made it possible to vary the direction of the progress of the strand paid off the package on this holder and to arrange the device for balancing the tensioning of the strands at the lower portion of the arbor of the twisting spindle. This makes it possible to remove the bobbin of the supply package off the stationary holder without affecting the position of this device, which reduces the time for package replacement and, consequently, raises productivity. With the device being arranged in the way disclosed herein, the strand tensioning conditions are optimized, since this device is rotated not by the strand but by the arbor of the twisting spindle.

Furthermore, the arrangement disclosed herein of the tensioning, balancing device provides for fuller utilization of the inter-balloon volume by increasing the capacity of the respective supply package, as well as for creation of such a strand tensioning means which provides, in turn, for stepping up the uniformity of the tensioning of the strand througout the entire period of unwinding thereof from a package.

Such variation of the direction of the progress of the strand has made it possible to arrange the feed-in device and the take-up mechanism below the twisting spindle, which, in turn, has made it possible to considerably reduce the overall dimensions of the machine, to offer improved servicing conditions, and produce take-up packages of a greater volume and weight.

The invention is further characterized in that said device for synchronous starting and arresting of the drives of the spindle, of the feed-in device, and of the take-up mechanism includes a spring-urged four-arm lever. One arm of the lever presents a handle for manual arresting and starting of said drives, a second arm is connected through a spring to the framework of the machine for resilient urging of the lever, a third arm is operatively connected, respectively, to the rotating sheave of the spindle drive, to the dog coupling of the drive of the feed-in device, and to the gear wheel of the ratchet-and-pawl mechanism of the drive of the take-up mechanism, while a fourth arm is connected to the pickup responsive to the tension of the twisted yarn. The lever thus acts to retain the above drives in their engaged state when the tension of the twisted yarn is normal.

It is advisable that the connection of the third arm of the four-arm lever to said drives should include a pair of rods connected to said arm, the first rod having the ends thereof connected pivotally to two-arm levers of which one cooperates with the rotating sheave of the spindle drive and the other presents the pawl engageable with the ratchet wheel of the ratchet mechanism of the drive of the take-up mechanism to arrest the latter. The second rod includes a fork embracing one of the half-couplings of the dog coupling of the drive of the feed-in mechanism, operable to disengage these half-couplings and thus to disable the drive.

The herein disclosed structure of the device for synchronous starting and arresting and the operative connection thereof with the respective drives of the spindle, of the feed-in device, and of the take-up mechanism is in fact the most simple. Furthermore, the structure of this device is determined to a great degree by the arrangement of the device for balancing the tensioning of the two strands, of the feed- in device and of the take-up mechanism below the twisting spindle, which has enabled arrangement of the device for synchronous starting and arresting in a position that is most convenient for operation and servicing.

The invention is still further characterized in that the rotating sheave of the spindle drive is mounted in a carrier movable along the arbor and bearing upon the two-arm lever of the rod of the four-arm lever, the sheave having in the upper portion thereof a tapering surface engageable with the tapering surface of the spring-urged friction clutch of the arbor, and the clutch having yet another tapering surface engageable with the braking rim of the spindle housing to arrest the spindle.

The above structure of the drive of the twisting spindle optimizes the conditions of transmission of the rotation from the main shaft of the machine and enables engagement and disengagement of the drive reliably and swiftly for short intervals, as well as for longer ones.

The invention is still further characterized in that the gear wheel of the ratchet mechanism of the drive of the take-up mechanism is mounted on the holder of the bobbin of the take-up package, the bobbin being mounted for free rotation by means of a plain bearing on a shaft positively rotated at a permanent angular speed.

This structure of the take-up mechanism provides for quick and reliable arresting thereof synchronously with the twisting spindle and with the feed-in device and ensures that the yarn being produced is wound onto the take-up package at a constant tension independent of the varying package diameter.

According to an alternative structure of the device for synchronous starting and arresting of the drives, the device is connected electrically with the drives of the spindle, of the feed-in device, and of the take-up mechanism, making up an electric circuit controlling these drive. The circuit includes a series connection of a manual switch and of a switch controlled controlled by the pickup responsive to the tension of the twisted yarn, for the switch to be operated when the twisted yarn becomes slack, the off position of either switch breaking the control circuit and thus disabling the drives which are connected in parallel in this circuit. The drive of the spindle includes an electric motor, while the respective drives of the take-up mechanism and of the feed-in device include solenoids of which the armatures are connected, respectively, with the pawl of the ratchet mechanism of the drive of the take-up mechanism and with one of the half-couplings of the dog coupling of the drive of the feed-in device.

The cooperative action of the structure of the device for synchronous starting and arresting of the said drives with the electric connection of this device with these drives becomes simplified and it also becomes possible to increase the angular speeds of the spindle, of the feed-in device, and of the take-up mechanism and thus to step up the capacity of the machine.

With both aforementioned embodiments of the device for synchronous arresting and starting of the drives it is expedient that the pickup responsive to the tension of the twisted yarn should include a spring-urged arm carrying a follower roller engaging the running twisted yarn, to additionally tension the latter with the effort of the spring urging the arm.

In embodiments of the present invention wherein the device for synchronous starting and arresting of the drives includes the four-arm lever it is expedient to have mounted under the pickup, i.e. under the spring-urged arm, a movable plate projectable to underlie the arm, to retain it in the yarn tensioning position thereof, and thus to maintain the device in the state corresponding to engagement of the drives when the machine, as a whole, is disabled.

In embodiments of the present invention wherein the device for synchronous starting and arresting of the drives includes a manual switch and another switch it is expedient that the electric control circuit of the drives should include a start push-button connected in parallel with this other switch, to overrule this switch when starting the drives.

The present invention is further characterized in that the device mounted at the lower portion of the arbor for balancing the tensioning of the strands includes a bracket mounted on the bottom end of the arbor and two pairs of rollers arranged on this bracket symmetrically with respect to the axis of rotation of the arbor. The rollers in each pair are arranged one above the other, each pair simultaneously engaging either one of the strands and being rotated thereby, with the respective axes of rotation of the rollers lying in a plane perpendicular to the axis of rotation of the arbor.

The above structure of the device for balancing the tensioning of the strands is most simple both in its design and in maintenance, as compared with the hitherto known existing devices, since any one of the existing devices, should it be positioned at the lower end portion of the arbor, would have to be redesigned with consequent complication of its structure.

In accordance with one embodiment of the device for balancing the tensioning of the strands, it is advisable that the two pairs of the rollers should be arranged to one side of the bracket and that the rollers should be mounted for free rotation about stationary arbors. At least two similar rollers of the two pairs have toothed rims interconnecting these rollers for synchronous rotation.

In accordance with another embodiment of the device for balancing the tensioning of the strands, it is advisable that one pair of the rollers should be arranged therein to one side of the bracket and the other one to the opposite side of this bracket, with the similar rollers of the two pairs being non-rotatably mounted on the respective common arbors journalled for rotation in the bracket.

With the above structure of the device for balancing the tensioning of the strands, it is advisable to have a plate mounted on the bracket and underlying the pairs of the rollers. The plate has a pair of diametrally opposing notches to guide the two strands at the same angle toward the point of their engagement and twisting.

The arrangement of the device for balancing the tensioning of the strands at the lower end portion of the arbor and the above alternative structures of this device have enabled use of an apparatus for pneumatic threading of the strands into the passages of the holder and of the arbor. In this respect it is sufficient that the bracket should have an opening above the pairs of the rollers capable of receiving this apparatus which is preferably in the form of an air gun, for pneumatic threading of the strands. In accordance with the further feature of the invention, this air gun includes a curved bracket supporting two tubes extending at an angle relative to each other, the first one of the tubes having one end thereof communicating with a compressed air source and having the free end thereof provided with a nozzle, the second tube having one end thereof secured in the bracket and communicating with the exterior of this bracket for communication with the axial passage of the arbor, and the other end of the second tube being received with a clearance in the free end of the first tube in the direction of the stream of air issuing from this first tube to form therewith an aspirator to create suction within this second tube and within the passage of the arbor.

With the above structure of the air gun it becomes possible to effect simultaneous threading of the strands into the passages of the holder and of the arbor, and to reduce the strand threading time.

To effect feeding of the strands at uniform tension through the passages, both throughgoing, of the holder and of the arbor, the stationary holder is associated with means for tensioning the strands. The means includes spider rotatable by the strand and supported by the holder through an axial thrust plain bearing, one prong of the spider accommodating thereon a weight slide suspended from the strand and movable by the latter along this prong.

The spider is preferably associated with a spring-loaded plate-type tensioner adapted to receive the strand between the plates thereof.

The above structure of the strand tensioning means, owing to the incorporation therein of the weight slide suspended from the strand, optimizes the conditions of unwinding of the strand from packages of different shapes, including those with double-end bobbins. Moreover, it ensures uniform tensioning of the strand during the twisting and provides for adjustability of the tensioning means within necessary ranges depending on the character of the yarn produced.

It is clear from the above that the herein disclosed single-process twisting machine for producing twisted yarn from two strands offers a series of advantages over the hitherto known machines for similar applications. Among these advantages are more compact structure, easier operating and maintenance, higher productivity, an improved quality of the yarn being produced, and it enables incorporation of a pneumatic strand threading means. Furthermore, the incorporation in the herein disclosed machine of the device for synchronous starting and arresting of the drives of the twisting spindle, of the feed-in device, and of the take-up mechanism enables one operator to handle a greater number work stations, reduces the waste of the strands, saves electric power by elimination of useless rotation of the drives after a strand has become either broken or slack, and offers replacement of the packages separately at any work station without stopping the entire machine, all of which steps up the utilization ratio of the machine.

BRIEF DESCRIPTION OF THE DRAWING

The present invention willl be further described in connection with an embodiment of a single-process twisting machine for producing twisted yarn from two strands, with reference to the accompanying drawings, wherein:

FIG. 3 is a partly sectional view of the twisting spindle;

FIG. 4 is a strand tensioning means, as viewed in the direction of arrow A in FIG. 3;

FIG. 5 is a sectional view along line V—V in FIG. 4;

DESCRIPTION OF THE PREFERRED EMBODIMENTS

Figure 1:
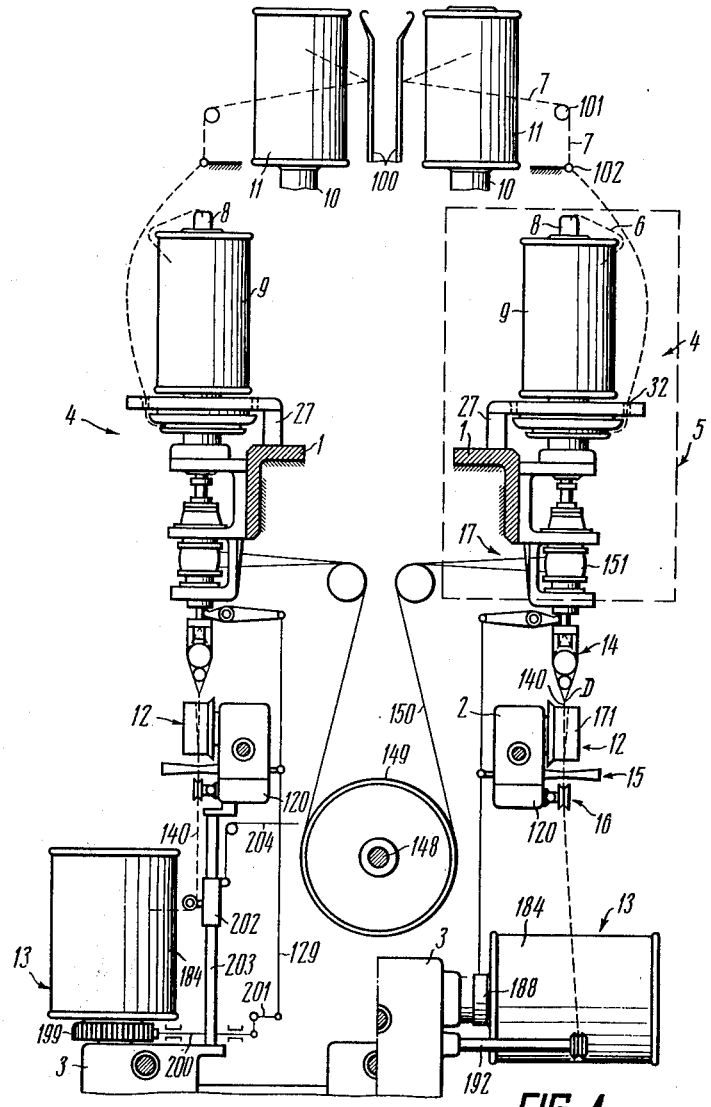
FIG. 1 is a cross-sectional view of a single-process twisting machine embodying the invention.

Referring now to the appended drawings, a single-process twisting machine for producing twisted yarn from two strands includes a pair of spindle rails 1 (FIGS. 1 and 2) extending at two sides of the framework of the machine made up of two box-like structures 2 and 3. A plurality of identical work stations 4 are spaced along the longitudinal axis of the machine, each station including a twisting spindle 5 mounted on the spindle rail 1 and adapted to impart the first and second twists to strands 6 and 7 and supporting thereon a stationary holder 8 for the bobbin 9 of the supply package of the first strand 6. The holder 10, 10' of the bobbin 11 of the supply package of the other strand 7 is mounted on the framework of the machine outside of the spindle. A feed-in device 12 is mounted in the structure 2 below the spindle 5 and is adapted to impart a uniform motion to the strands 6 and 7 paid off under tension from the respective supply packages, while a take-up mechanism 13 is mounted on the structure 3 below the feeding device 12. A device 14 for balancing the tension of the strands 6 and 7 is mounted between of the spindle 5 and the feed-in device 12.

The feeding device 12 and the take-up device 13 are provided with respective drives transmitting thereto rotation from the main shaft of the machine.

Each work station 4 incorporates a device 15 for synchronous arresting and starting of the respective drives of the spindle 5, of the feed-in device 12 and of the take-up mechanism 13, this device being operatively connected with the said drives. The device 15 includes a pickup 16 responsive to the tension of the twisted yarn formed from the strands 6 and 7.

The pickup 16 is positioned intermediate of the feed-in device 12 and the device 14 for balancing the tensioning of the strands 6 and 7 and is adapted to send a signal to the device 15, should the twisted yarn become slack, to disable the drives of the spindle 5, of the feed-in device 12, and of the take-up mechanism 13.

Figure 2:
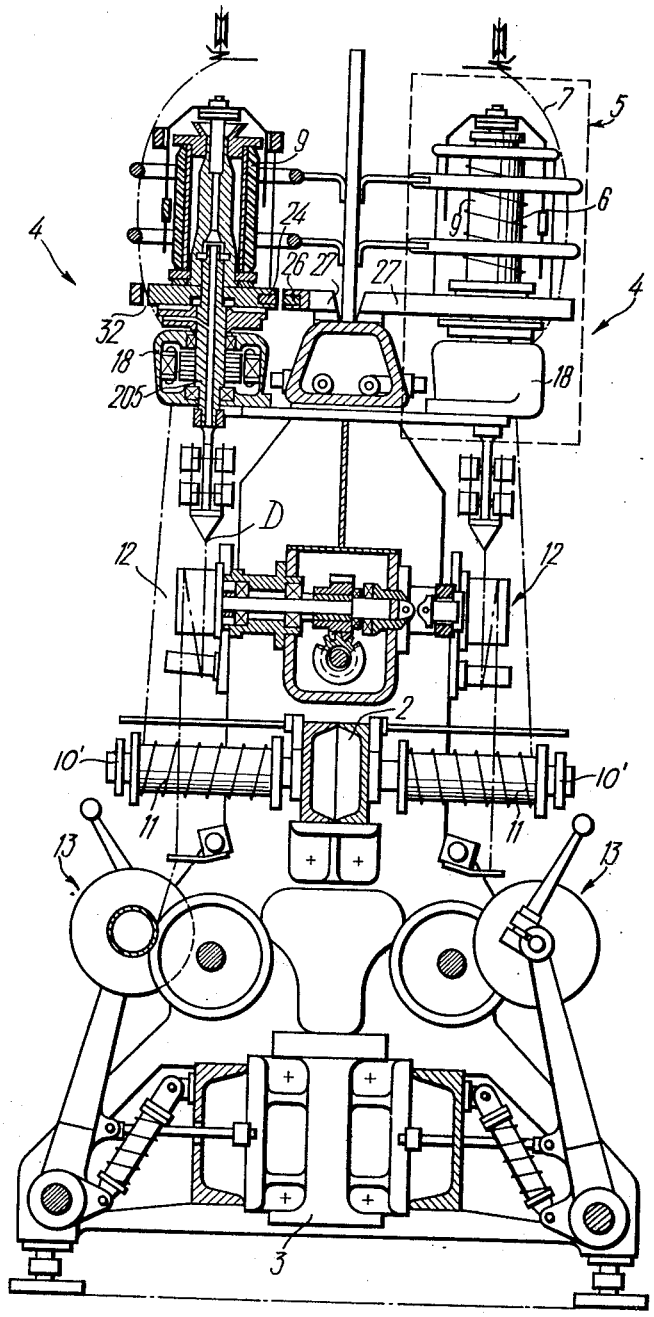
FIG. 2 is a cross-sectional view of another embodiment of a single-process twisting machine.

The spindle 5 may be rotated either mechanically by a drive 17 transmitting rotation from the main shaft of the machine to the spindle 5, or else by an individual electric motor 18 (FIG. 2).

The spindle 5 includes an arbor 19 (FIG. 3), a twisting disc 20, the holder 8 of the bobbin 9 of the supply package of the strand 6, means 21 for tensioning the strand 6 paid off the package, and the device 14 for balancing the tensioning of the strands 6 prior to imparting thereto the second twist, in which way the yarn is formed. This device 14 is mounted on the lower end of the arbor 19.

The holder 8 is mounted on the upper portion of the arbor 19 by means of bearings 22 and 23 and is retained from rotation by permanent magnets 24 mounted on the flange 25 of this holder 8 and cooperating with magnets 26 mounted on a bracket 27 supported by the spindle rail 1.

The flange 25 of the holder 8 supports an internal, balloon limiter 28 made up of two rings 29 and 30 interconnected by rods 31 to provide for uniform spacing of the rings. An annular gap 32 is left between of the flange 25 and the magnet 27 to allow passage of the strand 7 paid off the bobbin 11 (not shown in FIG. 3).

Secured to the central portion of the arbor 19 below the flange 25 is the twisting disc 20 made up of two parts 33 and 34 spaced vertically and receiving therebetween a tube 35 guiding therein the strand 7. The tube 35 is made of a wear resistant material and is readily replaceable when worn out. The tube 35 has one end thereof received in a radial passage of the arbor 19, the internal space 36 of the tube 35 communicating with the axial passage 37 of the arbor 19. The axial passage 37 of the arbor is a through one, i.e. it opens at both end faces of the arbor 19.

To feed the strand 6 reeled off the bobbin 9 toward the device 14 for balancing the tensioning of the strands, there is made in the holder 8 a through passage 38 extending coaxially with the axial passage 37 of the arbor and communicating therewith. In this manner, there is provided in the stationary holder 8 and in the rotatable arbor 19 a through passage for motion of the strand 6 under a desired tension to the device 14 for balancing the tensioning of the strands.

At the upper portion of the holder 8 there is positioned the device 21 for tensioning the strand 6 reeled off the package of the bobbin 9. This device 21 includes spider with two prongs 39 and 40, a weight slide 41, and a replaceable dry friction plain bearing 42.

The prongs 39 and 40 of the spider are curving as shown in FIG. 3, to envelope from above the bobbin 9. The prong 40 of the spider counterbalances the prong 39.

The prong 39 has made therein a longitudinal port 43 (FIG. 4) receiving therein the slider 41 reciprocably slidable longitudinally of the prong 39. The slider has made in the lateral sides thereof grooves engaging the prong 39 (FIG. 5) which latter in this way guides the motion of the slider 41. The latter has made therein an aperture 44 offering passage to the strand 6 which supports the slider 41 suspended therefrom and is responsible for its reciprocation along the prong 39.

At the junction of the prongs 39 (FIG. 3) and 40, the spider is provided with a flange 45 having an opening therethrough by means of which the spider is freely received on a stud 46 for rotation under the action of the strand 6 reeled off the package. The stud 46 has made therein a through passage 47 coaxial with the passage 38 of the holder 8. This stud 46 is fixedly received in the upwardly flaring portion 48 of the passage 38 of the holder 38 and has a support flange 49 upon which the flange 45 of the spider bears through the dry friction bearing 42.

The bearing 42 is made in the form of a washer made of a material with corresponding friction characteristics. When the herein disclosed machine is operated with strands of different yarn counts, the bearing 42 is accordingly replaced with another bearing having a different external diameter calculated to yield a desired mean friction radius.

To expand the range of control of the tensioning of the strand, the prong 39 of the spider has mounted thereon a plate-type tensioner 50 including an arbor 51 (FIG. 4) receiving thereabout freely rotatable plates 52 biased toward each other by spring 53. The strand 6 is made to pass intermediate of the plates 52 and thus is tensioned accordingly.

In this device adjustment of the tension may be effected either by replacement of the springs 53 or else by interposing a replaceable washer (not shown in the drawings) between the plates 52 and the spring 53.

The arbor 51 is secured in a bracket 54 (FIG. 3) mounted on the prong 39.

Figure 6:
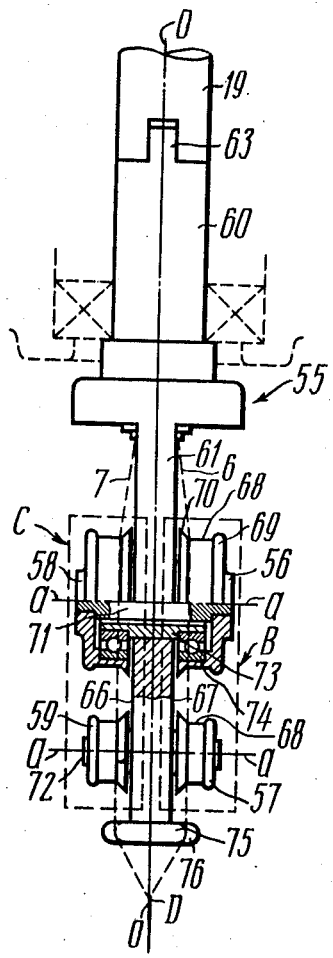
FIG. 6 is a general partly sectional view of the device for balancing the tensioning of the strands.

As it has been already indicated hereinabove, the lower end of the arbor 19 has mounted thereon a device 14 for balancing the tensioning of the strands. This device 14 includes a bracket 55 (FIG. 6) and two pairs of rollers, respectively, B and C with rollers 56, 57 and 58 and 59 carried by this bracket.

Figure 7:
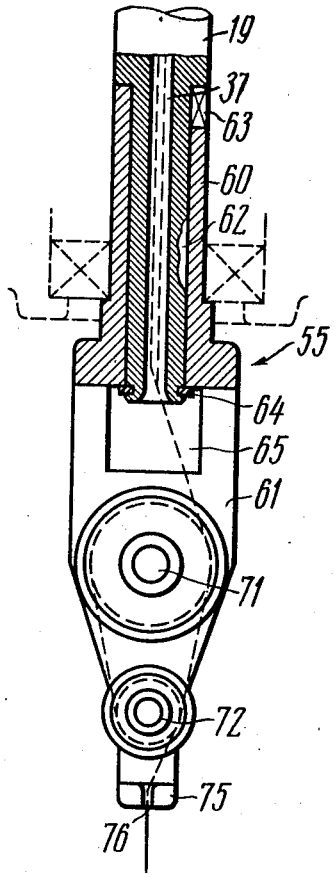
FIG. 7 is a partly sectional view of the device shown in FIG. 6, turned through 90° about the axis of the arbor.

The bracket 55 has a cylindrical top portion 60 (FIG. 7) and a bottom portion 61 shaped as a bar. The cylindrical portion 60 has made therein a longitudinal through passage 62 receiving therein the bottom end of the arbor 19, the bracket being secured to this arbor by means of a splined connection 63 and a lock ring 64 received about the lower end portion of the arbor 19 projecting from the passage 62 of the portion 60. The portion 61 of the bracket carries the roller pairs B and C, an opening 65 being provided in this portion 61 of the bracket upwardly of the rollers.

Figure 8:
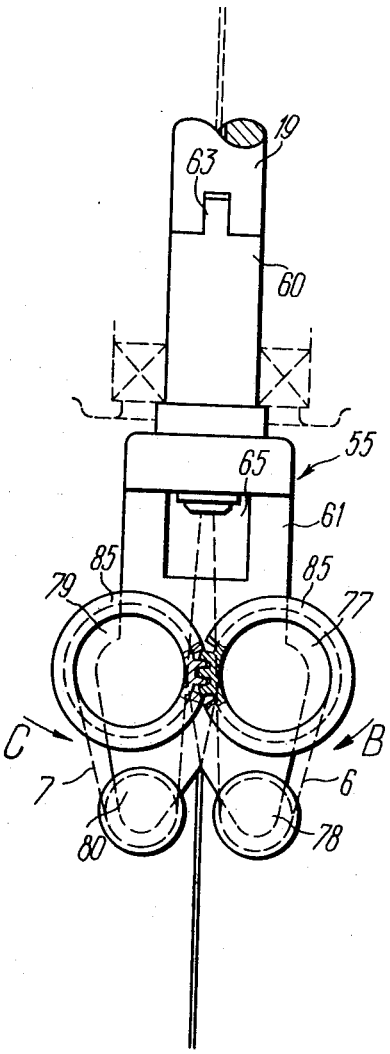
FIG. 8 is a general view of another modification of the device for balancing the tensioning of the strands.

The two pairs B and C (FIGS. 6 and 8) of the rollers are arranged symmetrically with respect to the axis 0—0 of rotation of the arbor 19. In each pair B and C the respective rollers 56, 57 and 58, 59 are arranged one above the other, each pair having the strand passing thereabout, whereby the rollers are set into rotation. The geometric axes a-a of rotation of the rollers belong to a plane perpendicular to the axis 0—0 of rotation of the spindle.

The rollers of each one of the pairs B and C are of the same diameter; alternatively, the bottom rollers 57 and 59 may have a smaller diameter than the top ones 56 and 58.

There are two ways to mount the pairs B and C of the rollers on the lower part 61 of the bracket.

In the first modification the rollers are arranged at the opposite sides of the portion 61. The pair B (FIG. 6) of the rollers is disposed at the side 66 of the portion 61, whereas the pair C of the rollers is at the side 67 opposite to the side 66.

In this modification all the rollers 56 – 59 have each a cylindrical surface 68 defined by rims 69 and 70. The top rollers 56 and 58 of the pairs B and C, i.e., the similar rollers are fixedly mounted on an arbor 71 common to both rollers, while the bottom rollers 57 and 59 of the pairs B and C are fixedly mounted on their common arbor 72. The two arbors 71 and 72 are rotatable in the bracket. With the arbor 71 rotatably extending through an opening of the journal 73 fixed in the portion 61 of the bracket. The journal 73 supports the rollers 56 and 58 by means of bearings 74.

The arrangement of the rollers 57 and 59 and of the arbor 72 is similar to the respective arrangement of the rollers 56, 58 and the arbor 71.

In this modification of the arrangement of the rollers it is necessary to mount a plate 75 on the portion 61 of the bracket, under the pairs B and C of the rollers. The plate 75 has two diametrally opposing notches 76 (FIG.

7) underlying, respectively, the two pairs B and C of the rollers and being adapted to guide the two strands 6 and 7 (FIG. 6) at the same angle toward the point D of their engagement in order to impart the second twist to the strands.

Figure 9:
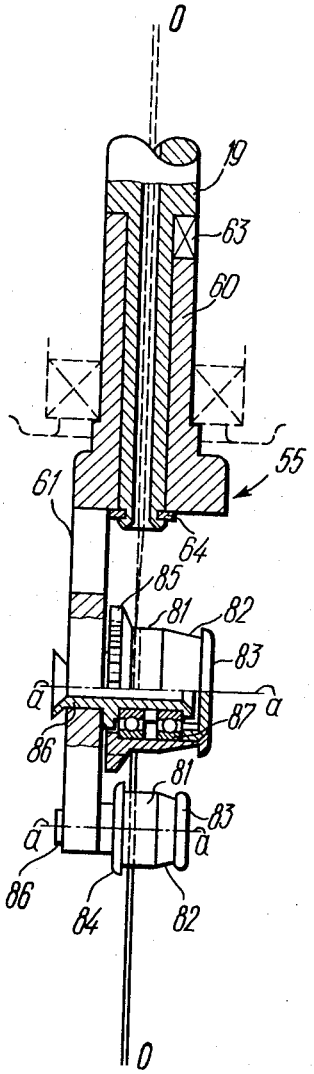
FIG. 9 is a partly sectional view of the device shown in FIG. 8, turned through 90° about the axis of the arbor.

According to the other modification of the arrangement of the pairs B and C (FIGS. 8 and 9) of the rollers, the latter are arranged under the arbor 19 to one side of the portion 61 of the bracket 55. The portion 61 of the bracket 55 in this modification is offset relative to the cylindrical portion 60 and to the axis 0—0 of rotation of the arbor 19 and extends parallel to this axis, as is shown in FIG. 9. In this modification the rollers 77, 78 and 79, 80 (FIG. 8), respectively, of the pairs B and C have each a cylindrical surface 81 (FIG. 9) merging with a tapering surfaces 82 ending with a rim 83. The cylindrical surface 81 of each one of the bottom rollers 78 and 80 ending with a plain rim 84, while the cylindrical surface 81 of each one of the top rollers 77 and 79 ends with a toothed rim 85. The toothed rims 85 (FIG. 8) of the rollers 77 and 79 mesh to ensure synchronous rotation of these rollers.

The rollers 77 – 80 are mounted on stationary arbors 86 (FIG. 9) and are freely rotatable thereabout, with the arbors 86 being fixedly mounted in the portion 61 of the bracket and supporting thereon the rollers 77 – 80 by means of bearings 87.

The holder 10 (FIG. 1) of the bobbin 11 of the package paying off the strand 7 is described hereinbelow in two modifications.

According to the first modification the holder 10 is arranged vertically above the twisting spindle 5. This holder 10 includes a stud 88 (FIG. 10) fixedly mounted in an opening in a block 89. The block 89 is provided with a handle 90 and is received in the ear 91 of a bracket 92 mounted by means of longitudinal rods 93 and vertical posts 94 on the framework of the machine.

The block 89 is supported by the bracket 92 by means of a pivot 95, whereby the block 89 with the stud 88 may be manually pivoted to position the stud horizontally for replacement of the bobbin 11. The pivot 95 is offset relative to the longitudinal axis of the stud 88, whereby the latter can be retained in a vertical position; to eliminate a torque an opening in the block 89 receives therein a pin 96 with a press-fit, the pin 96 bearing against another pin 97 received in the ear 91 and secured to the bracket 92.

The stud 88 has a flange 98 positioned above the block 89. Intermediate of this flange 98 and the block 89 there is mounted a bracket 99 carrying a rod 100 adapted to guide the strand 7 paid off the bobbin 11 over a roller 101 and into a strand guide 102 the aperture of which is arranged coaxially with the axis 0—0 (FIG. 1) of rotation of the arbor 19.

By means of bearings 103 there is mounted on the stud 88 (FIG. 10) a sleeve 104 with a support flange 105. The sleeve 104 being thus arranged, it is freely rotatable about the stud 88. The sleeve is adapted to receive thereon the bobbin 11 of the respective supply package.

Figure 10:
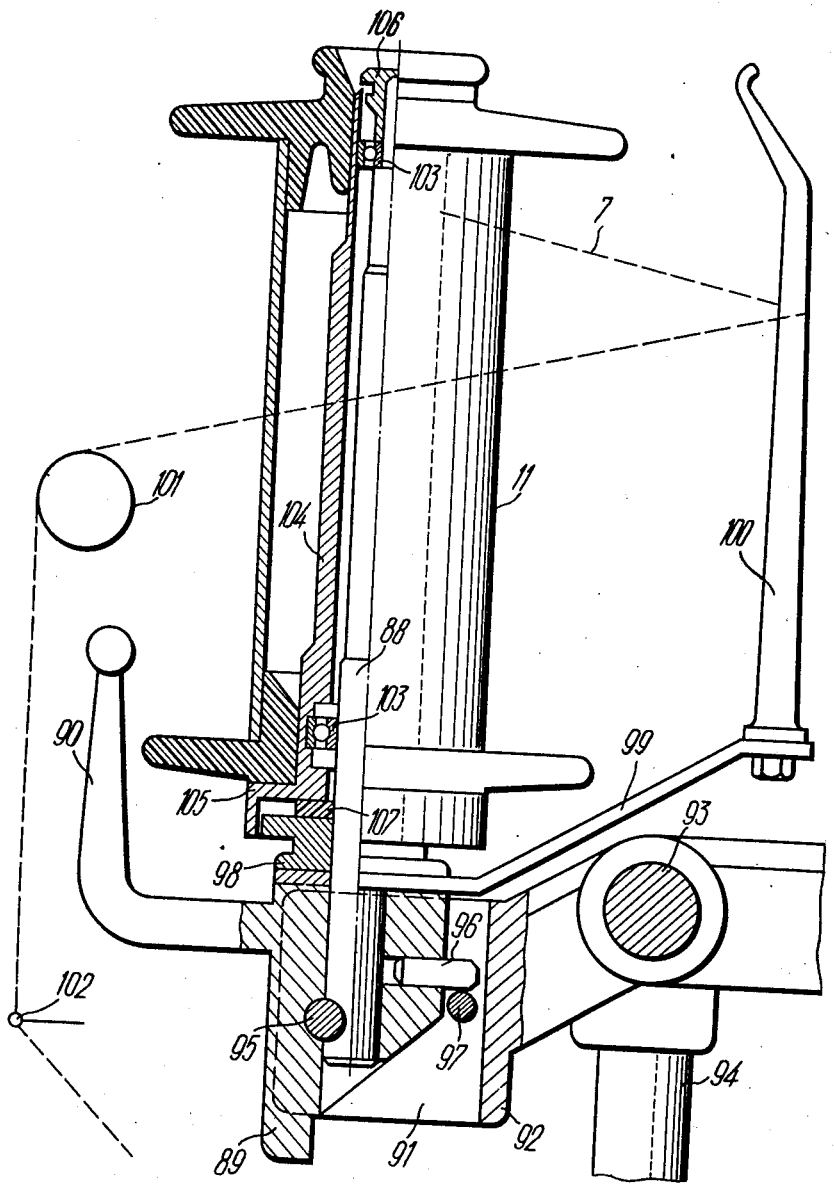
FIG. 10 is a partly sectional view of the holder of the bobbin of the supply package positioned outside the spindle.

The sleeve 104 is freely slidable along the stud 88, with the bottom bearing 103 having its external ring secured in the sleeve 104 and having its internal ring received about the stud 88, as is shown in FIG. 10. The top bearing 103 has its internal ring secured on the stud 88 by means of a nut 106, while its external ring is freely received in the sleeve 104, as is shown in FIG. 10.

Interposed between the flange 105 of the sleeve 104 and the flange 98 of the block 89 is a dry friction sliding bearing 107 made of a material with desired friction characteristics.

This bearing 107 acts as the means for tensioning the strand 7 paid off the package 11. This tension may be controlled by replacement of this bearing with an appropriate one having a different external diameter ensuring the desired mean radius of friction. In this arrangement permanent tensioning of the strand unwound from a full package and that unwound from either a partially or completely exhausted one is maintained thanks to the permanence of the ratio of the varying diameter of the package to the varying weight thereof, including the weight of the holder 10 and of the bobbin 11.

According to the other modification, the holder 10 (FIG. 2) is arranged horizontally below the twisting spindle 5, intermediate of the feeding device 12 and the take-up mechanism 13.

Figure 12:
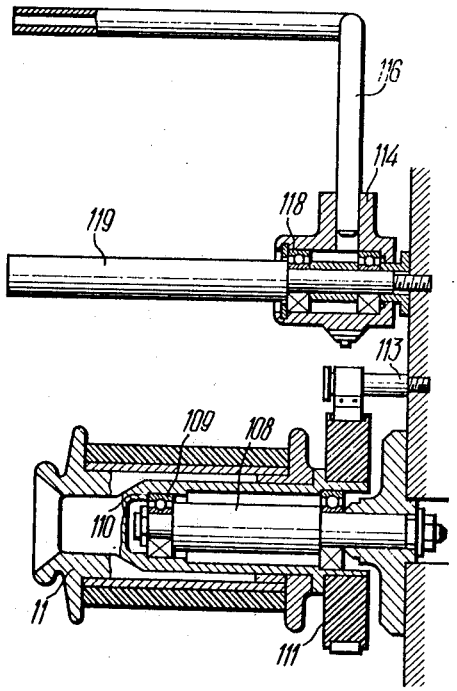
FIG. 12 is a sectional view along line XII—XII in FIG. 11.
Figure 11:
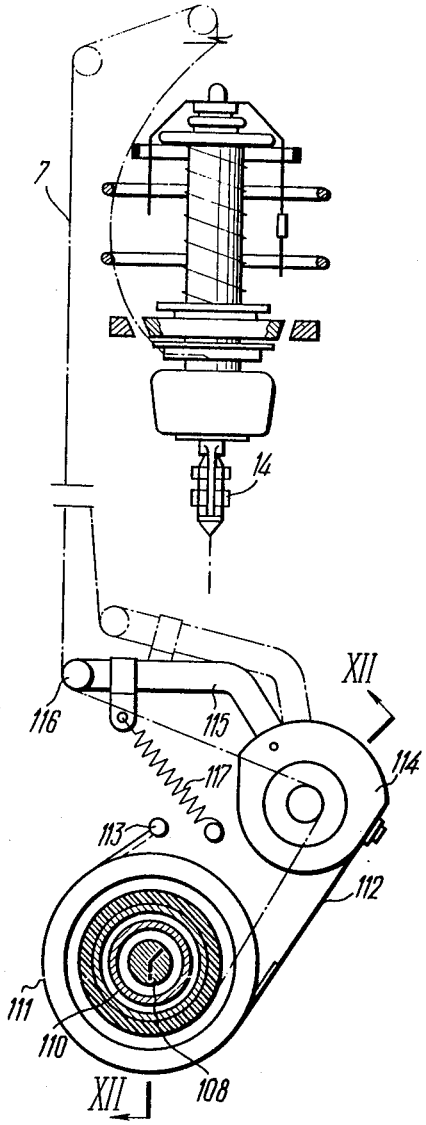
FIG. 11 is a partly sectional view of another modification of the holder of the supply package, positioned outside the spindle.

This holder 10 (FIGS. 11 and 12) includes a stud 108 horizontally arranged on the framework of the machine and supporting thereon bearings 109 (FIG. 2) affording free rotation of a sleeve 110 carrying the bobbin 11 of the supply package. One end portion of the sleeve 110 is provided with a brake pulley 111, over a portion of which there runs a brake band 112 (FIG. 11) having one end thereof secured to the framework of the machine by means of a stud 113, while the other end of the band is secured to an arm 114 of a two-arm lever 115. The other arm 116 of the lever 115 is urged by a spring 117 and bears upon the strand 7 paid off the package 11, with the tension of the strand counterbalancing the effort of the spring 117. The two-arm lever 115 has its arm 114 supported by means of a pivot 118 (FIG. 12) on a stud 119 mounted on the framework of the machine in a cantilever fashion.

The tension of the strand is maintained constant in this modification, as the strand is being unwound from the package, owing to variation of the position of the arm 116 resulting from pivoting of the arm 115, in which way the tension of the brake band 112 is correspondingly varied. The latter varies the braking effort applied to the pulley 111 of the sleeve 10, whereby the tension of the strand 7 unwound from the package is maintained permanent.

The structure of the device 15 (FIG. 1) for synchronous starting and arresting of the drives and operative connection thereof with the respective drives of the twisting spindle 5, of the feeding device 12 and of the take-up mechanism 13 are selected to correspond to the manner of driving of the twisting spindle 5. Thus, in cases where the spindle 5 is driven mechanically by means of a drive mechanism 17 (FIG. 3), it is advisable to employ a mechanical operative connection; alternatively, when an individual motor 18 (FIG. 2) is employed to drive the spindle 5, this operative connection is preferably effected electrically.

Described hereinbelow are two modifications of the device 15 for time synchronous starting and arresting of the drives and of its connection with these drives.

Figure 13:
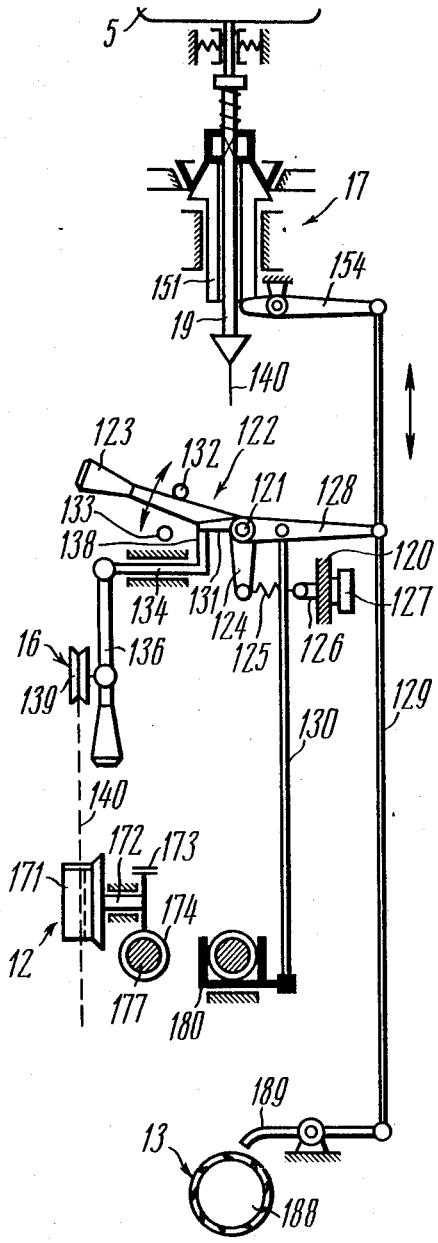
FIG. 13 is a schematic diagram of the device for the synchronous arresting and starting of the drives of the twisting spindle, of the feeding device and of the take-up mechanism, showing operative connection of the device with the drives.

According to the first modification, the apparatus 15 for synchronous starting and arresting of the drives is arranged in a box 120 (FIG. 13) and includes an arbor 121 supporting a rotatable four-arm spring-urged lever 122.

The arm 123 of this four-arm lever 122 is a handle for manual starting and arresting of the drives of the twisting spindle 5, of the feed-in device 12, and of the take-up mechanism 13. The second arm 124 of the lever 122 is connected by a spring 125 with a tensioning screw 126 associated with a nut 127 and mounted in the housing of the box 120. The third arm 128 of the lever 122 is operatively connected through a rod 129 and a pair of two-arm levers pivotally mounted on the respective ends of this rod with the sheave of the drive 17 of the spindle 5 and with the gear wheel of a ratchet mechanism of the drive of the take-up mechanism 13; the same last-mentioned arm is connected by a rod 130 with the dog coupling of the drive of the feed-in device 12. The fourth arm 131 of the lever 122 is connected to the pickup 16 responsive to the tension of the twisted yarn, so that when the tension of the yarn is normal, the lever 122 maintains the respective drives of the spindle, of the feeding device 12, and of the take-up mechanism 13 in an engaged position.

To limit rotation of the arm 122, there are provided adjacent to the handle, i.e., to the arm 123, a pair of stops 132 and 133, respectively, arranged below and above the handle, and secured in the housing of the box 120.

Figure 14:
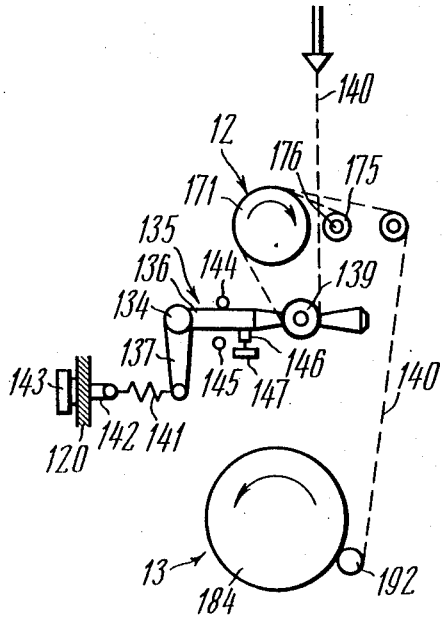
FIG. 14 is the pickup of the device shown in FIG. 13.

The pickup 16 responsive to the tension of the twisted yarn includes an arbor 134 (FIG. 14) pivotally supporting thereon a spring-biased lever 135. This lever 135 has three arms 136, 137, 138 (FIG. 13), with the arm 136 carrying a freely rotatable follower 139 about which the twisted yarn 140 under inspection is made to pass, and the yarn being formed from the two strands 6 and 7 having imparted thereto the second twist. The arm 136 is adapted to cooperate with the arm 131 of the lever 122 at normal tension of the yarn. This cooperation results in the lever 122 maintaining the drives of the spindle 5, of the feed-in device 12, and of the take-up mechanism 13 in the engaged position.

The arm 137 (FIG. 14) is connected by a spring 141 to a tensioning screw 142 associated with a nut 143 and mounted in the housing of the box 120, in which way resilient biasing of this arm is effected, with the effort of this spring counterbalancing the tension of the yarn 140 imparted by the second twist. To limit rotation of the lever 135, there are mounted, respectively, above and below the arm 136 of this lever 135 stops 144 and 145 secured on the housing of the box 120.

To retain the lever 135 is a position tensioning the yarn 140 when the whole machine is deenergized, the lever has a lug 146 associated with a movable plate 147 which is projected to underlie this lug 146 prior to deenergization of the machine and is retracted from under this lug when the machine is started. To facilitate control of all the work stations of the machine as the latter is arrested and started, is advisable that all the plates 147 should be interconnected with a common flexible member associated with a single actuator.

The mechanical drive 17 of the spindle 5 includes a main shaft 148 (FIG. 1) of the machine with a pulley 149 rotated by means of an endless tape 150 wrapped around a sheave 151.

The sheave 151 (FIG. 3) is mounted by means of bearings 152 in a carrier 153 reciprocable along the arbor 19 and bearing upon one of the two two-arm levers 154 of the rod 129, in which way there is effected operative connection of the drive of the twisting spindle 5 and the device 15. The carrier 153 is received in a yoke 155 secured in the housing 156 of the spindle, on which the two-arm lever 154 is pivotally mounted. The upper portion of the sheave 151 includes a tapering surface 157 cooperable with a friction clutch including two half clutches 158 and 159.

The half-clutch 158 has two tapering surfaces of which the inner one 160 is congruent with the tapering surface 157 of the sheave 151 and is adapted to engage this surface 157 at rotation of the spindle, with the other, external surface 160*a* being adapted to engage when the spindle is arrested the tapering surface 161 of a brake rim 161*a* provided on the housing 156 of the spindle 5.

The half-clutch 159 is biased by a spring 162 against the half-clutch 158 and is slidably connected with the arbor 19 by means of a sliding key connection 163. The half-clutch 159 is provided with guide lugs 169 received in a groove in the face of the half-clutch 158, in which way a floating connection of the two halves of the clutch is effected.

The arbor 19 is mounted by means of bearings 165 in a carrier 166 arranged under a twisting disc 20 and resiliently biased radially by springs 167 received in a yoke 168 of the housing 156 of the spindle. The arbor 19 passes freely through an axial opening 169 of the sheave 151 and has its lower end projecting into the passage 62 of the cylindrical portion 61 of the bracket 55. This cylindrical portion 61 is mounted by bearings 170 in the carrier 153.

The feeding device (FIG. 1) is intended to forward the strands 6 and 7 at a permanent speed from the supply packages to the take-up mechanism 13 in synchronism with the speed of rotation of the twisting spindle 5.

Figure 16:
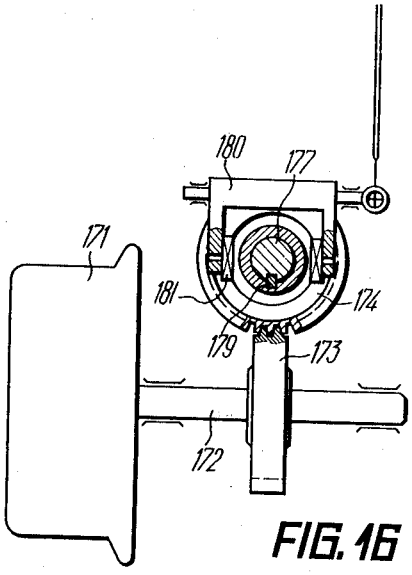
FIG. 16 is the side view of the device shown in FIG. 15.
Figure 15:
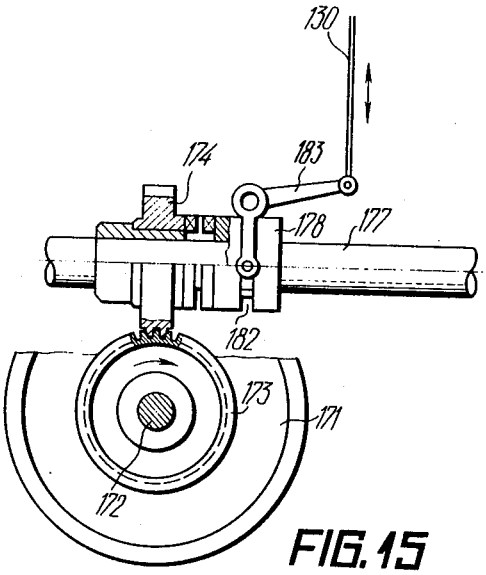
FIG. 15 is a partly sectional front view of the drive of feed-in device.

The feeding device 12 is mounted on the structure 2 and includes a feed roller 171 rigidly mounted on a shaft 172 (FIGS. 15 and 16) and driven for rotation by meshing gears 173 and 174. The device further includes a guide roller 175 (FIG. 14) freely received about a stud 176 mounted on the structure 2.

The stud 176 is inclined with respect to the shaft 172 of the feed roller 171, whereby the twisted yarn 140 makes several turns about the feed roller (as can be seen in FIG. 1), which provides for adequate friction between the yarn and the surface of the feed roller, ensuring sufficient traction effort for slip-free forwarding of the yarn.

The gear 173 (FIG. 16) is secured on the shaft 172, while the gear 174 is freely rotatable about a shaft 177 rotatable by the main shaft of the machine and can be drivingly connected to this shaft 177 through the dog coupling. One half-coupling 178 (FIG. 15) of this coupling is slidably non-rotatably connected with the shaft 117 by means of a key connection 179 (FIG. 16), whereby the half-coupling 178 may be reciprocated longitudinally on the shaft by a fork 180. The fork 180 includes blocks 181 received in a groove 182 (FIG. 15) of this half-coupling and is connected by a lever 183 to the rod 130, in which way there is effected operative connection of the coupling with the device 15 for synchronous starting and arresting of the drives. The other half-coupling of the dog coupling is integral with the gear 174.

Figure 17:
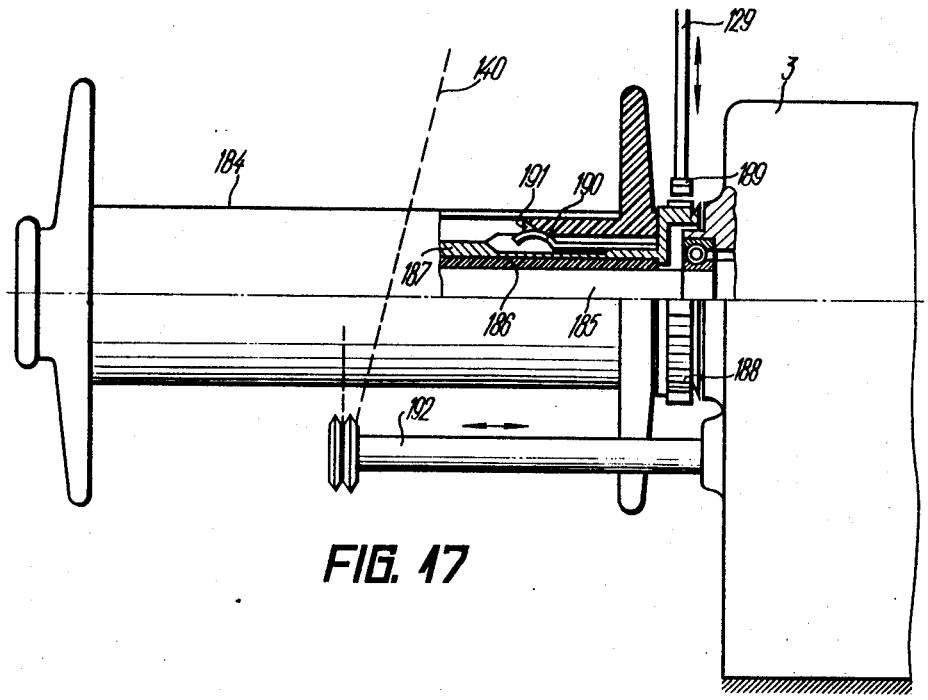
FIG. 17 is a partly sectional view of the holder of the take-up package.
Figure 18:
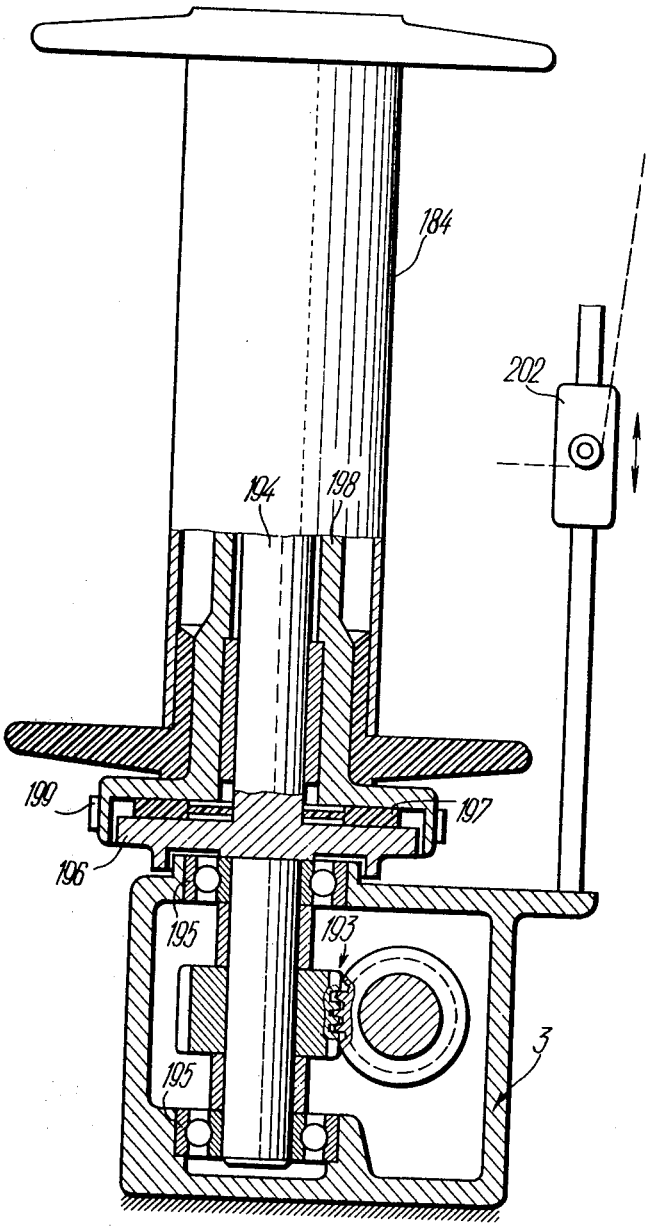
FIG. 18 is another modification of the holder of the take-up package.

The take-up mechanism 13 (FIG. 17) effects winding of the twisted yarn 140 onto a take-up bobbin 184 and is described hereinbelow in two modifications: in the first one the take-up bobbin 184 is arranged horizontally (FIG. 17), while in the second modification the take-up bobbin 184 is arranged vertically (FIG. 18).

The take-up mechanism 13 with the horizontally arranged bobbin 184 (FIG. 17) is mounted on the structure 3 and includes a ratchet mechanism and a shaft 185 rotated from the main shaft 148 of the machine at a constant speed. The shaft is associated with a radial dry friction plain bearing 186 by means of which there is mounted for free rotation about this shaft 185 the holder 187 of the take-up bobbin 184.

The holder 187 carries thereon the ratchet wheel 188 of the ratchet mechanism of which the pawl 189 is pivotally mounted on the housing of the structure 3 and form the other two-arm lever of the rod 129. The pawl 189 engages the gear wheel 188 to arrest rotation of the holder 187, in which way this holder is operatively connected with the synchronous starting and arresting device 15. To retain the bobbin 184 on the holder 187, the latter is provided with leaf springs 190 which are adapted to enter grooves 191 made in the bobbin 184 as the bobbin 184 is put onto the holder.

Traversing of the turns of the yarn longitudinally of the bobbin 184 is effected by means of a traverser 192 mounted on the structure 3 and reciprocated longitudinally of the holder 187 by an eccentric which is driven rotationally from the main shaft of the machine. This traversing motion is widely known in the art and, therefore, not described here in detail.

To maintain uniform tensioning of the yarn being wound onto the bobbin 184, irrespectively of the varying diameter of the package being wound, there should be maintained permanence of the ratio of the varying diameter of the package to the varying weight thereof, including the weight of the holder and of the bobbin, both at the beginning and at the end of the winding of a package.

The value of the pre-determined tension of the yarn depends on the diameter of the shaft 185 and the factor of friction of the bearing 186.

According to the other embodiment of the take-up mechanism 13 wherein the bobbin 184 is arranged vertically (FIG. 18), the mechanism includes a ratchet mechanism and a gear couple 193 transmitting rotation from the main shaft of the machine to a shaft 194 journalled in bearings 195 mounted on the structure 3. The shaft 194 includes a flange 196 upon which the holder 198 of the take-up bobbin 184 bears through a dry friction plain thrust bearing 197. The flange of a holder 198 is made integral with the wheel 199 of a ratchet mechanism with the latter including a pawl 200 (FIG. 1) engaging the wheel 199 to arrest the holder 198. The pawl 200 is reciprocably movable along appropriate guides by a lever 201 pivotally connected with the rod 129, in which way the operative connection of the take-up mechanism with the synchronous starting and arresting device 15 is effected.

Traversing of the yarn longitudinally of the bobbin is effected by a traversing slide 202 reciprocated along a vertical bar 203 by a cable 204 receiving motion from the main shaft of the machine.

Uniform tensioning of the yarn being wound onto the bobbin is ensured by providing the same conditions as those described hereinabove in connection with the first modification of the take-up mechanism. The value of the predetermined tension is defined by the mean friction radius of the thrust bearing 197 (FIG. 18).

The operation of each work station of the herein disclosed single-process twisting machine for producing twisted yarn from two strands is as follows.

The bobbin 9 (FIG. 3) of the supply package of the strand 6 is mounted on the stationary holder 8. The strand 6 is threaded through the opening 44 in the weight slide 41, between the plates of the tensioner 50, and through the passage 38 of the holder and the axial passage 37 of the arbor 19.

The strand 7 (FIG. 1) from the bobbin 11 on the holder 10 is threaded over the roller 101 of the guide 102, through the annular gap 32 (FIG. 3) between the magnets 26 and the flange 25, whereafter it is threaded through the space 36 of the tube 35 of the twisting disc 20 and through the axial passage 37 of the arbor 19.

The strands 6 and 7 extending from the passage 37 of the arbor 19 are threaded, respectively, over the rollers of the pairs B and C of the device 14 for balancing the tensioning of the strands.

In a modification where the pairs B and C of the rollers are arranged to one side of the bracket 55 (FIGS. 8 and 9) the strands 6 and 7 are both threaded between the pairs B and C of the rollers, whereafter either one of the strands is threaded over the rollers 79, 80 of the pair C in a clockwise direction, while the other strand is threaded over the rollers 77, 78 of the pair B in a counterclockwise direction. To balance the tensioning of the strands, it is sufficient to wind one turn of each strand about the respective pair.

In a modification where the two pairs of the rollers are arranged at the opposite sides 66 and 67 of the bracket 55 (FIGS. 6 and 7), one of the strands is threaded about the rollers of the pair C disposed at the side 66 of the bracket, while the other strand is threaded about the rollers of the pair B disposed at the side 67 of this bracket. Then the strands are guided into the respective notches 76 of the plate 75 and brought together, whereafter the combined strands are threaded over the follower 139 (FIG. 14) on the spring-biased lever 135, i.e., of the pickup 16, pulled toward the feeding device, and turned, or wound, several times about the feed roller 171 and the guide roller 175. Therefrom the strands are threaded through either the transverser 192 or through the traversing slide 202 (FIG. 18) to the bobbin 184 of the take-up mechanism 13. The leading ends of the strands are secured to the bobbin 184.

After the strands have been threaded at every work station of the machine, the main drive of the machine is energized, whereby the rotation of the main shaft 148 is transmitted simultaneously to all the spindles 5, to the feeding devices 12, and to the take-up mechanisms 13 of the machine.

With the spindle 5, the device 14 for balancing the tensioning of the strands, and the feeding roller 171 rotating, the strands 6 and 7 are unwound from the respective package on the bobbin 9 and 11 by the rotation of the feed-in roller 171. The strand 6 is imparted the first twist at the portion thereof intermediate the point of engagement of this strand with the face end of the stud 46 (FIG. 3) as the strand moves through the passage 38 of the holder 8 and the point D of the engagement of the two strands 6 and 7.

The strand 7 is imparted the first twist, in the same direction as the strand 6, in the rotating balloon formed by this strand 7, by rotation of the twisting spindle 5 about the stationary package 8.

Upon having been imparted on the first twist in the same direction, the strands 6 and 7, after leaving the device 14 which balances the tensioning of the strands, are imparted the second twist in the opposite direction, owing to the rotation of the spindle 5, over the portion thereof intermediate of the feeding device 12 and the point D (FIG. 1) of the engagement of the two strands, and located intermediate of the devices 12 and 14. Therefore, as the strands 6 and 7 are imparted the second twist, the twisted yarn 140 is formed. As the yarn 140 is being formed, the spider of the device 21 (FIG. 3) for tensioning the strand 6 rotates about the stud 46 under the action of the strand 6 being paid off, and the weight slide 41 reciprocates vertically in the longitudinal port 43 (FIG. 4) of the prong 39 of the spider, facilitating unwinding of the strand from the supply package. In this case the strand 6 receives a part of its tension from the weight slide 41, since the latter is suspended from the strand, and another part from the plate-type tensioner.

The strand 7 is tensioned by the braking action applied to the bobbin 11 on the holder 10 (FIG. 10) bearing upon the dry friction plain bearing 107. In this case the tension may be adjusted by replacing the bearing with one of a different diameter. Uniformity and permanence of the tension from a full package to an exhausted one is maintained by the permanence of the ratio of the varying diameter of the package to the varying weight of the package, including the bobbin and the holder. To broaden the range of adjustment of the tension, and to conform to the running speed of the spindle and the count of the yarn, it is possible to employ additionally a plate-type strand tensioner (not shown in the drawing) similar to the plate-type tensioner 50.

In another modification, the tensioning of the strand 7 is effected by the brake band 112 (FIG. 11) running over the brake pulley 111. As the strand 7 is being unwound, it imparts rotation to the holder 10 with the bobbin, with the lever 115 balancing the tensioning of the strand and the spring 117 acting upon the brake band 112, whereby the latter applies a braking action through the pulley 111 to the holder 10. As the tension of the strand 7 varies, the braking torque is varied accordingly, whereby the tension of the strand 7 is stabilized until the package is completely exhausted.

Balancing of the tensioning of the strands 6 and 7 is effected by the device 14 prior to the strands being imparted the second twist, the previously described modifications of the device 14 for balancing the tensioning of the strands ensuring that equal lengths of the strands 6 and 7 are forwarded per unit of time, which positively prevents the faulty twisting sometimes called corkscrew twisting.

The twisted yarn 140 produced by the operation of the machine is gradually wound onto the bobbin 184 (FIGS. 17 and 18) of the take-up mechanism 13. As the yarn 140 is being produced, it is being maintained under a permanent tension and thus maintains the spring-urged lever 135 in a position where it abuts against the stop 144 and the arm 138 (FIG. 13) thereof abuts against the fourth arm 131 of the four-arm lever 122. This action maintains the latter in its "cocked" position wherein the arm 128 of the lever 122 retains the rod 129 and the double-arm lever 154 so that the sheave 151 of the drive of the twisting spindle 5 is in engagement with the friction clutch of the arbor 19, and the pawl 189 is disengaged from the toothed rim 188 of the holder 187 of the bobbin 184 of the take-up mechanism 13.

The rod 130 associated with the arm 128 of the lever 122 maintains the half-coupling 178 (FIG. 15) of the dog coupling in engagement with the other half-coupling by means of the fork 180, whereby rotation is transmitted from the shaft 177 to the feed roller 171.

Arresting of either one of the work stations of the machine is done manually by rotating the spring-biased lever 135 (FIG. 14) until it abuts against the stop 145, its arm 138 (FIG. 13) releasing the arm 131 of the four-arm lever 122. The spring 125 in this case rotates the lever 122 so that the handle 123 thereof abuts against the stop 133, whereby the rod 129 is displaced and the double-arm lever 154 releases the sheave 151. The latter disengages itself from the half-clutch 158 (FIG. 3) of the friction clutch, whereby this half-clutch 158 slides along the arbor 19 under the action of the spring 162, and the tapering surface 160*a* thereof engages the tapering surface 161 of the braking rim 161*a* and rotation of the spindle 5 is arrested.

When the rod 129 is displaced downwardly, the pawl 189 (FIG. 17) mounted on the opposite end of the rod is brought into engagement with the teeth of the ratchet toothed rim 188 of the holder 187 and arrests rotation of the latter. Simultaneously the rod 130 (FIG. 15) is displaced and displaces the fork 180 which disengages the half-coupling 178 of the dog coupling from the other half-coupling, whereby rotation is no longer transmitted from the shaft 177 through the gears 174, 173 to the feed roller 171.

Should the twisted yarn become slack on account of either one of the strands having been broken, the action of the spring 141 (FIG. 14), of which the effort is no longer counterbalanced by the tension of the yarn 140, makes the lever 135 rotate to abut against the stop 145, whereby the arm 138 of this lever is driven away from the arm 131 of the four-arm lever 122.

The latter rotates and disables the drives of the spindle 5, of the feed-in device 12, and of the take-up mechanism 13, as it has been already described hereinabove.

When all the work stations of the machine are arrested, i.e., when the machine as a whole is deenergized or stopped, the twisted yarn 140 running over the follower 139 on the lever 135 becomes slack, whereby the lever 135 lowers itself, which might result in an uncalled-for disabling of the drives of the spindle 5, of the feeding device 12, and of the take-up mechanism 13.

To prevent this unnecessary disabling it is essential that the lever 135 should not vary its position in this situation. To attain this, the plate 147 is projected so as to underlie the lug 146 of the lever 135, whereby the latter is retained in its operative position when the machine is started. This means that all the drives are engaged for operation.

Figure 19:
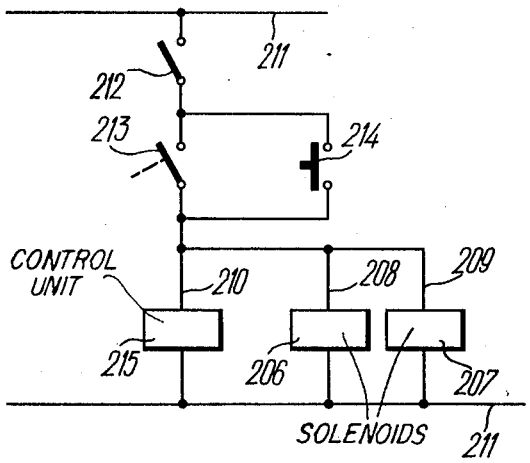
FIG. 19 shows a circuit diagram illustrating the electric connection of the device for the synchronous starting and arresting of the drives with the drives of the twisting spindle, of the feed-in device, and of the take-up mechanism.

In a modification where the spindle 5 is rotated by an individual electric drive, e.g., a three-phase asynchronous electric motor 18 (FIG. 2) with a squirrel-cage rotor 205 of which the hollow shaft is the arbor 19 of the spindle 5, it is expedient that the operative connection of the electric motor 18, of the respective drives of the feed-in device 12, and of the take-up mechanism 13 with the synchronous starting and arresting device 15, should be effected by electrical means, i.e. by an electric control circuitry of these drives. This is attained by providing the drives of the take-up mechanism 13 and of the feed-in device 12 with respective solenoids 207 and 206 (FIG. 19).

Figure 20:
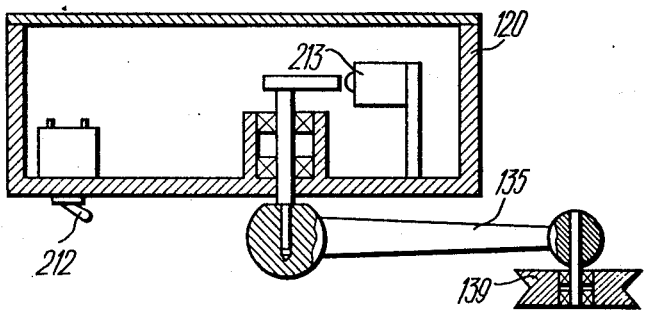
FIG. 20 is the pickup of the device for the synchronous starting and arresting of the drives, as illustrated in FIG. 2.

The individual energizing circuits 208 and 209, respectively, of the solenoids 206 and 207, and the energizing circuit 210 of the electric motor 18, are connected in parallel, and this parallel connection of the energizing circuits is connected to a power supply source 211 through the synchronous starting and arresting device 15. In this embodiment the device 15 includes a series connection of a manual switch 212 (FIG. 20) and a switch 213 operable by the pickup device 16 at either slackening or breakage of the yarn, i.e. by the spring-biased lever 135, to break the energization circuit and thus to arrest the respective drives. The two switches 212, 213 are arranged in the box 120.

The manual switch 212 is intended to make it possible to switch off and arrest the corresponding work station in order to thread in the strands and in any other case when the work station is to be arrested.

To interlock the switch 213 (FIG. 19) when the said drives are being started, the electric control and energization circuitry includes a start push-button 214 connected in parallel with the switch 213.

The asynchronous motor 18 is controlled through a unit 215 included into its energization circuit. The unit 215 includes a magnetic starter which operates when voltage is supplied to the unit through the control circuitry and thus provides for feeding of three-phase voltage of an increased frequency to the asynchronous motor. When the control circuit is broken, the control unit cuts off the voltage, whereby the magnetic starter disconnects the motor of the spindle from the three-phase supply mains and at the same time feeds a direct-current pulse of a predetermined duration through a timer provided in the same unit 205 to the windings of this spindle motor, in order to effect dynamic braking of this motor. Neither the magnetic starter or the timer are described in detail in the present disclosure, since they are widely known per se in the art and their adaptation for the presently described embodiment can be easily done by any competent person.

Figure 21:
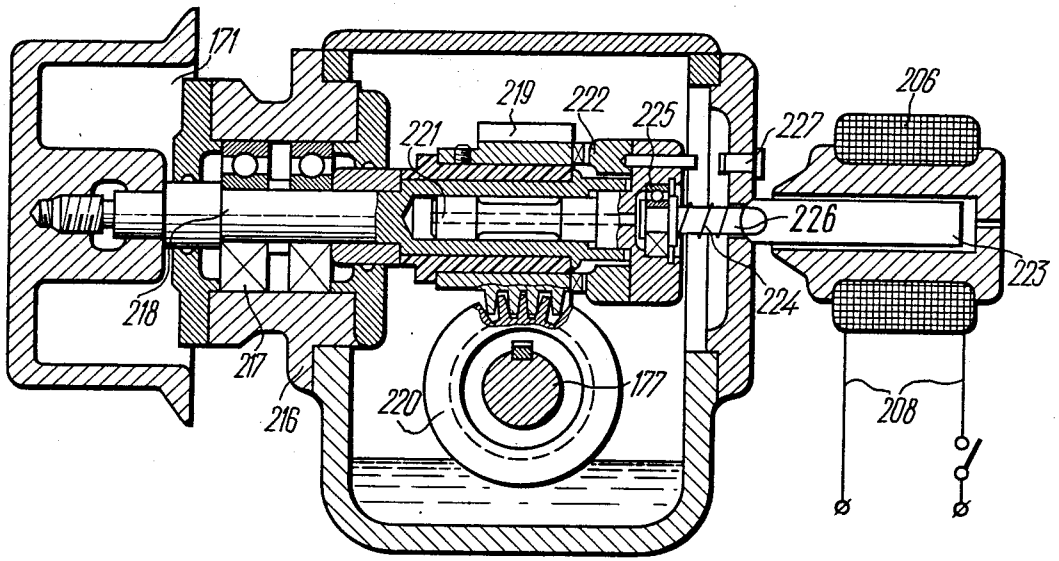
FIG. 21 is a cross-sectional view of the drive of the feed-in device of the twisting machine illustrated in FIG. 2.

In the presently described embodiment of the drive of the twisting spindle 5, the drive of the feed-in device 12 is as follows. A carrier 216 (FIG. 21) associated with the box-like structure 2 has a shaft 218 journalled therein in bearings 217. The feeding roller 171 is mounted on the end portion of this shaft 218. The opposite end of the shaft 218 has rotatably mounted thereon a helical gear 220 secured on the shaft 177 receiving rotation from the main shaft of the machine. The end of the shaft 218 has cut therein a bore receiving a stud 221 fixedly connected with a half-coupling 222 of a dog coupling. This stud 221 in the shaft 218 is connected with the armature 223 of the solenoid 206 and is axially reciprocable by this armature 223 and by a return spring 224 through a ball bearing 225 and a connecting pintle 226. The stud 221 has a driving radial lug (not shown in the drawings) engaging a corresponding notch in the shaft 218, whereby driving torque is transmitted from the half-coupling 222 to this shaft 218.

The face end of the gear 219 is provided with driving lugs, so that this gear acts as the second half-coupling of the dog coupling. The last-mentioned half-coupling and the carrier 216 are provided with cooperating stops 227 limiting rotation of the feed roller 171 after the drive of the latter has been disabled.

In the working or normal state of the presently described device the solenoid 206 is deenergized. In this state the effort of the spring 224 results in engagement of the lugs of the half-coupling 222 with those of the gear 219. Since the stud 221 is non-rotatable relative to the shaft 218, a driving connection between the shaft 177 and the feed roller 171 is maintained.

The dog coupling 222 is rotated relative to the connecting pintle 226, owing to the provision of the bearings 225.

When the solenoid 206 is energized, it attracts its armature 223 against the action of the spring 224, and this armature, while being thus attracted, retracts the half-coupling 222 from the lugs of the gear 219, the effort being transmitted through the pintle 226 and the bearing 225, whereby the gear 219 is now rotating idle on the shaft 218. This rotation is not transmitted to the feed roller 171. When being thus retracted, the half-coupling 222 comes into engagement with the stops 227, whereby rotation of the feed roller 171 is arrested.

Figure 22:
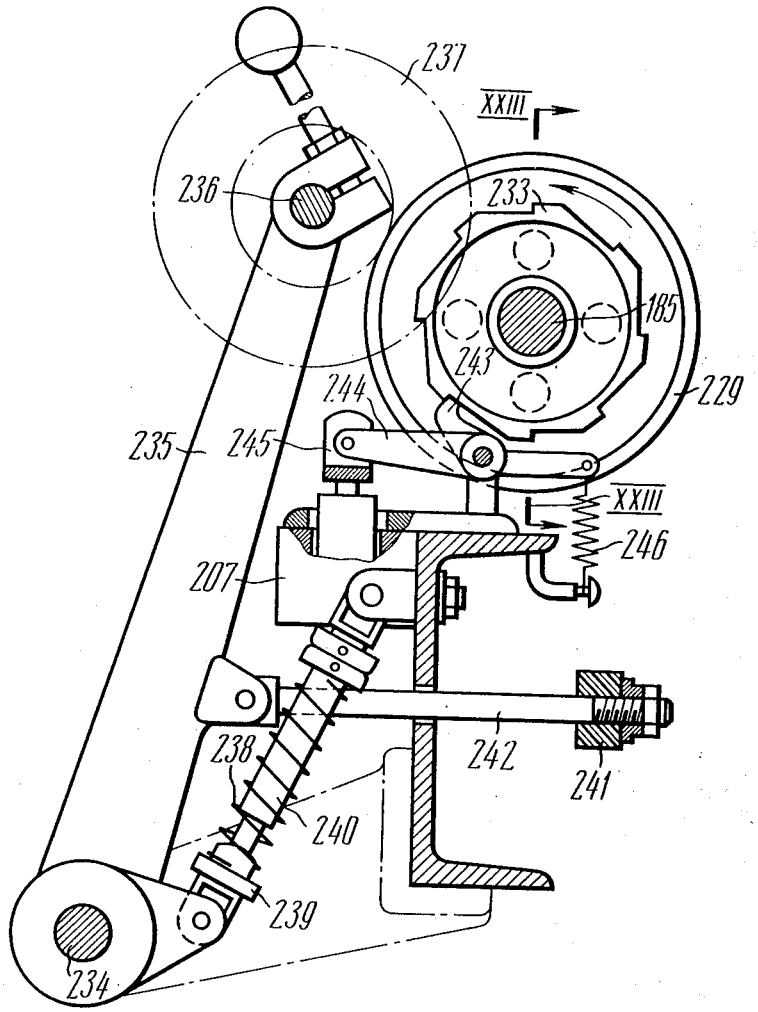
FIG. 22 is a side view of the take-up mechanism of the twisting machine illustrated in FIG. 2.
Figure 23:
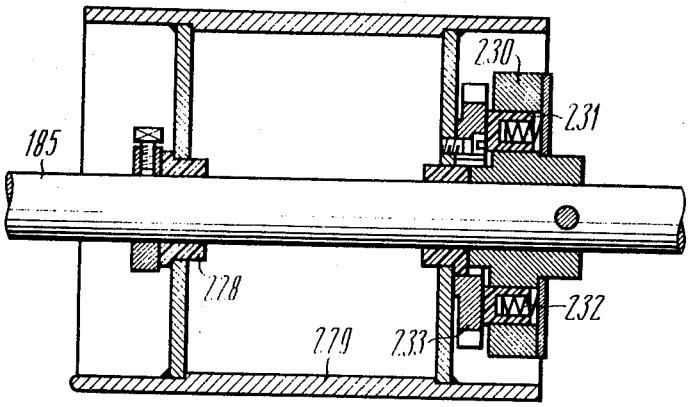
FIG. 23 is a sectional view along line XXIII—XXIII in FIG. 22.

The take-up mechanism 13 of the presently described embodiment has the following structure. The rotating shaft 185 (FIGS. 22 and 23) has mounted thereon bearings 228 rotatably supporting a friction cylinder 229 and a dog coupling including a half-coupling 230 having plugs 231 received in its apertures. These plugs 231 are pressed by springs 232 against the end face of a ratchet wheel 233 attached to the friction cylinder 229. A stationary shaft 234 (FIG. 22) mounted on the framework pivotally supports a lever 235 carrying on the free end thereof an arbor 236 with the bobbin holder. The take-up bobbin 237 is journalled on this holder by means of bearings which are not shown in the drawings. The take-up bobbin is urged into engagement with the friction cylinder 229 by a spring 238 supported by rotatable studs 239 and 240.

Pivoting of the lever 235 into a position where the bobbin 237 is put thereon, and threading of the yarn is effected, is limited by a stop 241 mounted on a stud 242. The friction cylinder 229 receives rotation from the shaft 185 through the permanently engaged dog coupling.

The friction cylinder 229 is arrested by engagement of the ratchet wheel 233 with a pawl 243 connected through a lever 244 to the armature of the deenergized solenoid 207.

When the solenoid 207 is deenergized, the pawl 243 engages the ratchet wheel 233 under the effort of a spring 246 attached to a lever 244. The spring 238 urges the bobbin 237 toward the friction cylinder 229 with a continuous effort. In this way there is maintained a permanent tension of the yarn being wound onto the take-up bobbin 237 and a permanent contact pressure (throughout the time of the winding of a take-up package) between the take-up bobbin and the friction cylinder 229, owing to retention of the permanence of the driving torque throughout the working range of the pivoting of the lever 235 carrying the holder with the take-up bobbin 237. The lever 235 is retained in its swung-away position by the same spring 238 owing to the reversed direction of the torque applied by this spring to the lever 235, i.e., to the toggle action of the connection of the spring with the lever.

When the take-up bobbin 237 has been put onto the holder, and the strands have been threaded to this bobbin, the lever 235 is manually pivoted from its swung-away position into the working position in which the bobbin 237 positively engages the driving friction cylinder 229. When the work station is started, the solenoid 207 is energized, and the armature thereof disengages the pawl 243 from the ratchet wheel 233 against the action of the spring 246. The half-coupling 230 which is positively drivingly connected with the shaft 185 transmits rotation to the friction cylinder 229, and the yarn is wound onto the take-up package 237. When the work station is arrested, the solenoid 207 is deenergized, and the spring 246 effects engagement of the pawl 243 with the ratchet wheel 233, whereby both the friction cylinder and the take-up bobbin are arrested.

The operation of the single-process twisting machine with the presently described embodiment of the drives of the spindle, of the feeding device, and of the take-up mechanism is basically similar to its operation described hereinabove, with the only difference being that here, prior to threading the strands over the follower 139 (FIG. 29) of the spring-biased lever 135, the manual switches 212 at every work station are turned into the off position to prevent accidental starting of the drives of these work stations. After the strands have been threaded the manual switches are turned to on, and the start button 214 is depressed to engage the drives of the twisting spindle, of the take-up mechanism, and of the feed-in device.

When the yarn becomes slack, and when either of the strands become broken, the spring-biased lever 135 is pivoted by its spring and operates the switch 213. The latter breaks the control circuit of the drives of the spindle, of the feeding device, and of the take-up mechanism. This means, as it has been already described, that the electric motor 18 of the spindle drive is deenergized and its windings receive a direct-current pulse effecting dynamic braking of the rotating parts of the spindle. Simultaneously, the solenoids 206 and 207 disable, in the manner described hereinabove, the drives of the feed-in device 12 and of the take-up mechanism 13.

To effect simultaneous starting of the electric motors 18 of the spindles 5 of all the work stations of the machine, and to synchronize their running speed with those of the feed-in devices 12 and take-up mechanism 13, the electric circuitry of the machine includes a programming timer (not shown in the drawings) wired into the electric control circuit of the drives to effect swift pulse-type engagement of the drives of the feeding devices 12 and of the take-up mechanisms 13, and to interlock the switches 213 for the acceleration period of the spindles.

Figure 24:
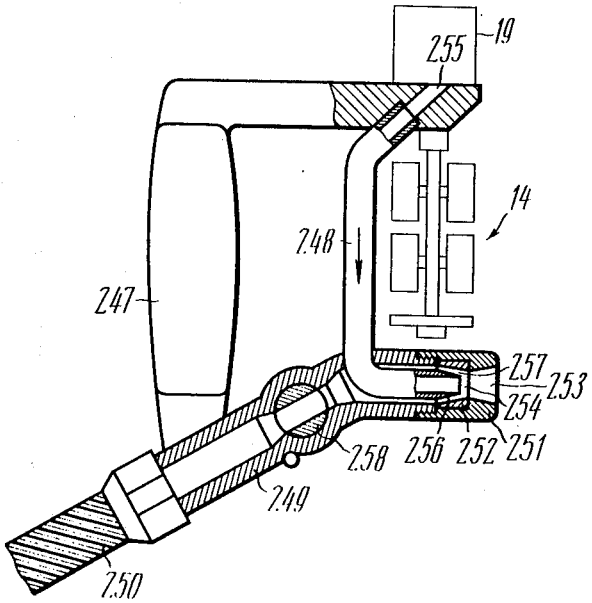
FIG. 24 is a partly sectional view of the device for pneumatic threading of the strands.

To speed the threading of the strand 6 through the passages 38 (FIG. 3) and 37, respectively, of the holder 8 and of the arbor 19, as well as the threading of the strand 7 through the tube 36 and the passage 37 of the arbor 19, the herein disclosed machine incorporates a pneumatic strand threading device. This device includes an air gun (FIG. 24) including a bracket 247 curving as it is shown in the drawing, wherein two tubes 248 and 249 are arranged at an angle to each other.

The tube 249 is connected via a conduit 250 to a compressed air source which is not shown in the drawings and which may be of any kind suitable for association with twisting machines.

The free end of the tube 249 is provided with a nozzle including a nut 251 and an insert 252. The nut 251 has made therein a tapering opening 253 coaxial with the central bore of the nut, of which the smaller diameter faces the tube, the insert 252 being received in the internal bore of the nut and adjoining this opening. The insert 252 has made therein a tapering bore 254 coaxial with the opening 253 of the nut and having its smaller diameter adjoining this opening.

The tube 248 has one its end secured in an opening 255 provided in the bracket 247 and opens on the external surface of this bracket for forming an aspiration nozzle. The other end of the tube 248 is bent as shown in the drawing, FIG. 24, and is introduced into the internal space of the tube 249 in the direction of the flow of compressed air therethrough. The end of the tube 248 has an external bevel 256 received in the tapering bore 254 of the insert 252 so that an annular gap 257 is formed intermediate of the external surface of the bent end of the tube 248 and the internal surface of the insert 252, which gap in combination with the nozzle forms an aspirator creating suction in the tube 248 and the passage 37 of the arbor 19.

The tube 249 is provided with a tap valve 258 operable to cut off the tube from the compressed air source and thus to disable the air gun.

To thread the strands 6 and 7, the air gun is introduced through the opening 65 (FIG. 7) of the bracket 53 to the face end of the arbor 19, projecting therefrom, and is positioned so that its aspiration inlet 255 (FIG. 240 forms a continuation of the axial passage 37 of the arbor 19. The tap valve 258 is rotated to start the flow of compressed air from the conduit 250 through the tube 249, the annular gap 257, and the outlet 253 of the nut into ambient atmosphere. This flow of compressed air in the tube 249 creates suction in the tube 248, whereby a corresponding flow of air is commenced through the passage 38 of the holder 8, through the tube 35, and through the passage 37 of the arbor 19. This flow of air draws the strands 6 and 7 therealong toward the inlet 255. Then the supply of the compressed air into the air gun is cut off and the air gun is withdrawn from the opening 65 of the bracket 55, whereafter the strands 6 and 7 are threaded in the manner described hereinabove over the rollers of the device 14 for balancing the tensioning of the strands.

What is claimed is:

1. In a single-process twisting machine for production of twisted yarn from two strands and having a plurality of work stations arranged along a longitudinal axis of the machine, each said work station comprising: a framework; a twisting spindle mounted for rotation on said framework and adapted to impart first and second twists to the strands; an arbor provided on said twisting spindle, the arbor being arranged vertically and having top and bottom ends; a radial passage provided in said arbor; a through axial passage provided in said arbor; a twisting disc associated with said spindle and having a hollow radial tube communicating through said radial passage with said axial passage of said arbor; a stationary first holder associated with said spindle adapted to support the bobbin of the supply package of the first stand, the first holder being mounted above said twisting disc on said top end of said arbor; a through passage provided in said stationary first holder coaxially with said axial passage in said arbor to offer a single through passage for the strand paid off the package of the bobbin on said stationary first holder; a first means for tensioning the strand paid off the bobbin of said stationary first holder, the first means mounted on said stationary holder and adapted for rotation under the action of the strand paid off the bobbin; a second holder for the bobbin of the supply package of the second strand, the second holder mounted on said framework outside said twisting spindle; a second means for tensioning the second strand, the second means being mounted on said second holder and adapted to maintain a permanent tension of the second strand passing through said hollow tube of said twisting disc and said axial passage on said arbor; a third means for balancing the tensioning of the two strands leaving said axial passage of said arbor prior to imparting a second twist to the strands and forming the twisted yarn, the third means being mounted on said bottom end of said arbor and actuated by the strands; a feed-in means for effecting uniform forwarding of the strands from said respective supply packages; the feed-in means being mounted downwardly of said twisting spindle and separate from the spindle under said third means for balancing the tensioning of the strands, and the feed-in means cooperating with the third means and the spindle to impart a second twist to the strands between the feed-in means and the third means of opposite direction with respect to the first twist; a take-up mechanism mounted downwardly of said twisting spindle and adapted to effect winding of the twisted yarn; a drive including a rotatable sheave and adapted to impart rotation to said twisting spindle; a first drive including a dog coupling and adapted to transmit rotation to said feed-in means to effect said uniform forwarding of the strands; a second drive including a ratchet-and-pawl mechanism adapted to supply rotation to said take-up mechanism to effect the winding of the twisted yarn; a fourth means for synchronous starting and arresting of said respective drives of said spindle, of said feed-in device, and of said take-up mechanism, the fourth means being operatively connected with said drives; a pickup responsive to the tension of the twisted yarn, associated with said synchronous starting and arresting device, and adapted to transmit an actuating signal to said last-mentioned device at slackening of the twisted yarn to simultaneously disable both of said drives, said pickup being arranged intermediate of said feed-in means and said third means for balancing the tensioning of the strands.

2. A machine as claimed in claim 1, wherein said fourth means for synchronous starting and arresting of said respective drives of said twisting spindle, of said feed-in means, of said take-up mechanism includes a spring-urged four-arm lever of which one arm is a handle for manual starting and arresting said drives, the second arm being connected through a spring with said framework of said machine for said urging of said lever, the third arm being operatively connected, respectively, with said sheave of said drive of said twisting spindle, with said dog coupling of said drive of said feed-in means and with said ratchet wheel of said ratchet-and-pawl mechanism associated with said drive of said take-up mechanism, and the fourth arm being connected with said pickup responsive to the tension of the twisted yarn to retain said drives in an engaged state thereof at normal tension of the yarn.

3. A machine as claimed in claim 2, wherein said pickup responsive to the tension of the twisted yarn includes a spring-urged lever carrying a follower roller engageable with the twisted yarn.

4. A machine as claimed in claim 3, wherein a movable plate is positioned downwardly of said spring-orged lever, said plate being projectable to under lie said lever to retain the same in a position tensioning the twisted yarn and maintaining the synchronous starting and arresting fourth means in a state retaining said drives in said engaged position at disabling of said machine.

5. A machine as claimed in claim 2, wherein said third arm of said four-arm lever is connected, respectively, with said sheave of said drive of said spindle, with said dog coupling of said drive of said feed-in means and with said ratchet wheel of said ratchet-and-pawl mechanism associated with said drive of said take-up mechanism by means of two rods connected with said arm, the first said rod having the ends thereof pivotally connected with two-arm levers of which one cooperates with said sheave and the other includes a pawl engageable with said ratchet wheel of said ratchet-and-pawl mechanism associated with the drive of said take-up mechanism to arrest said drive, said second rod being associated with a fork engaging one of the half-couplings of said dog coupling of said drive of said feed-in device to disengage it from the other half-coupling and thus to disable said drive.

6. A machine as claimed in claim 5, wherein said rotatable sheave of said drive of said spindle is mounted in a carrier movable axially of said arbor and arranged bearing upon said respective double-arm lever of said first rod of said four-arm lever, said sheave having in the upper portion thereof a tapering surface adapted to engage the tapering surface of a spring-urged friction clutch associated with said arbor, said clutch having another tapering surface adapted to engage the braking rim of the housing of said spindle to arrest said spindle.

7. A machine as claimed in claim 5, wherein said ratchet wheel of said ratchet-and-pawl mechanism of the drive of said take-up mechanism is mounted on the holder of the bobbin of the take-up package, said bobbin being mounted for free rotation on plain bearing means on a shaft rotatable at a permanent speed.

8. A machine as claimed in claim 1, wherein said fourth means for synchronous starting and arresting of said drives is electrically connected with said respective drives of said spindle, of said feed-in means, and of said take-up mechanism for forming an electric circuit controlling said drives and including a series connection of a manual switch and a switch operable by said pickup responsive to the tension of the twisted yarn at slackening of the yarn, to break said control circuit and to arrest said drives, said drives being connected in parallel in said control circuit, said drive of said spindle including an electric motor and said respective drives of said take-up mechanism and of said feed-in means including solenoids of which the armatures are connected respectively, with said pawl of said ratchet-and-pawl mechanism associated with said drive of said take-up mechanism and with one of the half-couplings of said dog coupling of said drive of said feed-in means.

9. A machine as claimed in claim 7, wherein said pickup responsive to the tension of the twisted yarn includes a spring-biased arm carrying a follower roller engaged by the yarn.

10. A machine as claimed in claim 7, wherein said control circuit of said drives includes a start push-button connected in parallel with said switch to overrule said switch at starting of said drives.

11. A machine as claimed in claim 1, wherein said third means for balancing the tensioning of said strands, and mounted on said bottom end of said arbor, includes a bracket supported by said bottom end and two pairs of rollers mounted on said bracket and arranged symmetrically with respect to the axis of rotation of said arbor, the rollers in each pair being arranged one above the other, each said pair being simultaneously engageable by the respective one of the two strands, imparting rotation to said rollers of said pair, the geometrical axes of rotation of said rollers belonging to a plane perpendicular to the axis of rotation of said arbor.

12. A machine as claimed in claim 11, wherein said two pairs of said rollers are arranged to one side of said bracket under said spindle and are mounted for rotation about stationary arbors of their own, at least two similar said rollers of said two pairs having toothed rims interconnecting the said rollers for synchronous rotation.

13. A machine as claimed in claim 11 wherein one said pair of said rollers is arranged to one side of said bracket and the other said pair is arranged to the opposite side of said bracket, the similar ones of said rollers of said two pairs being non-rotatably mounted on their respective common arbors rotatably mounted in said bracket.

14. A machine as claimed in claim 11, wherein a plate is mounted on said bracket under said pairs of said rollers, having a pair of diametrically opposing notches adapted to guide the strands at the same angle toward the point of their engagement and twisting.

15. A machine as claimed in claim 11, wherein said bracket has an opening made therein above said pairs of said rollers, adapted to receive therein fifth means for pneumatic threading of the strands into said axial passage of said spindle and into the passage of said stationary holder of said supply package.

16. A machine as claimed in claim 15, wherein said fifth means for pneumatic threading of the strands includes an air gun including a curving bracket having mounted therein two tubes extending at an angle to each other, the first said tube having one end thereof connected to a compressed air supply source and the free end thereof provided with a nozzle, the second said tube having one end thereof secured in said bracket and opening onto the external surface thereof for communication with said axial passage of said arbor, the other end of said second tube being introduced with a clearance into said free end of said first tube in the direction of the flow of air therefrom, forming with said nozzle an aspirator means for creating suction within said second tube and said passage of said arbor.

17. A machine as claimed in claim 1, wherein, to provide for forwarding of the strands through said stationary holder, said strand tensioning device includes a spider rotatable by the strand and bearing upon said holder through an axial thrust plain bearing, one prong of said spider accommodating a weight slide suspended from the strand adapted to reciprocate said slide along said prong.

* * * * *